US011021842B2

(12) United States Patent
Sawyer et al.

(10) Patent No.: US 11,021,842 B2
(45) **Date of Patent: *Jun. 1, 2021**

(54) INFILL FOR ARTIFICIAL TURF SYSTEM

(71) Applicant: Brock USA, LLC, Boulder, CO (US)

(72) Inventors: Daniel C. Sawyer, Boulder, CO (US); Stephen Keyser, Longmont, CO (US); Steven L. Sawyer, Huntington Beach, CA (US); Richard R. Runkles, Windsor, CO (US)

(73) Assignee: Brock USA, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/295,835

(22) Filed: Mar. 7, 2019

(65) Prior Publication Data

US 2019/0203425 A1 Jul. 4, 2019

Related U.S. Application Data

(63) Continuation of application No. PCT/US2018/025266, filed on Mar. 29, 2018.
(Continued)

(51) Int. Cl.
*E01C 13/08* (2006.01)
*D06N 7/00* (2006.01)

(52) U.S. Cl.
CPC ..... *E01C 13/083* (2013.01); *D06N 7/0086* (2013.01); *E01C 13/08* (2013.01);
(Continued)

(58) Field of Classification Search
CPC ..... E01C 13/08; E01C 13/083; D06N 7/0086; D10B 2505/202; B27M 1/00; Y10T 428/2982; Y10T 428/23921
See application file for complete search history.

(56) References Cited

U.S. PATENT DOCUMENTS 2,776,686 A 1/1957 Clark
5,326,614 A * 7/1994 Doose ..... B27L 11/00 144/162.1
(Continued)

FOREIGN PATENT DOCUMENTS

CN 102308047 A * 1/2012 ..... E01C 13/08
CN 109056459 A * 12/2018
(Continued)

OTHER PUBLICATIONS

Wikipedia entry for "Janka hardness test," https://en.wikipedia.org/wiki/Janka_hardness_test, 2019.*
(Continued)

*Primary Examiner* — Cheryl Juska
(74) *Attorney, Agent, or Firm* — MacMillan, Sobanski & Todd, LLC

(57) ABSTRACT

An artificial turf system includes a turf assembly having a turf backing and stands of artificial grass blades extending from the turf backing to form an artificial turf layer. Infill material is placed in between the blades of artificial grass and on top of the turf backing. The infill material has a composition of sand and organic particles. The infill material organic particles includes a plurality of wood particles where at least a portion of the wood particles define a length dimension oriented generally parallel to a grain structure of the wood particles. The length dimension is greater than a width or a thickness dimension and, in one example, may be in a range of about 0.5 mm to about 10 mm. The length dimension and one of the width or thickness dimensions may, in another example, define an aspect ratio within a range of 1:2 to 10:1.

29 Claims, 17 Drawing Sheets

Related U.S. Application Data

(60) Provisional application No. 62/478,254, filed on Mar. 29, 2017, provisional application No. 62/529,543, filed on Jul. 7, 2017, provisional application No. 62/616,858, filed on Jan. 12, 2018, provisional application No. 62/731,499, filed on Sep. 14, 2018, provisional application No. 62/733,116, filed on Sep. 19, 2018.

(52) U.S. Cl.
CPC . *D10B 2505/202* (2013.01); *Y10T 428/23921* (2015.04); *Y10T 428/2982* (2015.01)

(56) References Cited

U.S. PATENT DOCUMENTS

| | | | | |
|---|---|---|---|---|
| 5,958,527 | A | 9/1999 | Prevost | |
| 6,338,885 | B1 | 1/2002 | Prevost | |
| 6,390,729 | B1 | 5/2002 | Dooley et al. | |
| 6,402,426 | B1 | 6/2002 | Dooley et al. | |
| 6,551,689 | B1 | 4/2003 | Prevost | |
| 6,723,412 | B2 | 4/2004 | Prevost | |
| 6,729,068 | B2 | 5/2004 | Dooley et al. | |
| 6,746,752 | B2 | 6/2004 | Prevost | |
| 7,306,838 | B2 | 12/2007 | Prevost | |
| 7,943,212 | B2 | 5/2011 | Nusca et al. | |
| 7,987,776 | B1 | 8/2011 | Lanning et al. | |
| 7,992,491 | B1 | 8/2011 | Lanning et al. | |
| 8,034,449 | B1 | 10/2011 | Dooley et al. | |
| 8,039,106 | B1 | 10/2011 | Dooley et al. | |
| 8,158,256 | B2 | 4/2012 | Dooley et al. | |
| 8,173,209 | B2 | 5/2012 | Chereau et al. | |
| 8,205,546 | B2 | 6/2012 | Lanning et al. | |
| 8,481,160 | B2 | 7/2013 | Dooley et al. | |
| 8,496,033 | B2 | 7/2013 | Dooley et al. | |
| 8,497,019 | B2 | 7/2013 | Dooley et al. | |
| 8,497,020 | B2 | 7/2013 | Dooley et al. | |
| 8,507,093 | B2 | 8/2013 | Dooley et al. | |
| 8,563,099 | B2 | 10/2013 | Gilardi | |
| 8,752,779 | B2 | 6/2014 | Lanning et al. | |
| 8,758,895 | B2 | 6/2014 | Dooley et al. | |
| 8,795,834 | B2 | 8/2014 | Tetrault et al. | |
| 8,850,970 | B2 | 10/2014 | Lanning et al. | |
| 8,871,346 | B2 | 10/2014 | Dooley et al. | |
| 8,925,451 | B2 | 1/2015 | Lanning et al. | |
| 9,005,758 | B2 | 4/2015 | Dooley et al. | |
| 9,061,286 | B2 | 6/2015 | Dooley et al. | |
| 9,440,237 | B2 | 9/2016 | Dooley et al. | |
| 9,540,777 | B1 | 1/2017 | Tetrault | |
| 9,604,387 | B2 | 3/2017 | Dooley et al. | |
| 10,105,867 | B2 | 10/2018 | Dooley et al. | |
| 10,500,806 | B2 | 12/2019 | Lanning et al. | |
| 2002/0028307 | A1* | 3/2002 | Prevost | E01C 13/08 428/17 |
| 2005/0025989 | A1 | 2/2005 | Brandenburg | |
| 2006/0242901 | A1* | 11/2006 | Casimaty | A63C 19/00 47/65.9 |
| 2008/0176010 | A1 | 7/2008 | Sawyer et al. | |
| 2008/0216437 | A1* | 9/2008 | Prevost | E01C 13/08 52/589.1 |
| 2009/0118396 | A1 | 5/2009 | Faehner et al. | |
| 2010/0055461 | A1 | 3/2010 | Daluise et al. | |
| 2011/0262687 | A1 | 10/2011 | Dooley et al. | |
| 2011/0262727 | A1 | 10/2011 | Tu et al. | |
| 2012/0103268 | A1 | 5/2012 | Owens | |
| 2012/0183705 | A1 | 7/2012 | Chereau et al. | |
| 2012/0189786 | A1* | 7/2012 | Nusca | E01C 13/08 428/17 |
| 2012/0271260 | A1 | 10/2012 | Azad et al. | |
| 2012/0279125 | A1 | 11/2012 | Nusca et al. | |
| 2014/0060444 | A1 | 3/2014 | Owens | |
| 2018/0179711 | A1* | 6/2018 | Wu | E01C 13/08 |
| 2019/0338472 | A1* | 11/2019 | Nusca | E01C 13/08 |
| 2020/0102707 | A1* | 4/2020 | Keyser | B27L 11/02 |

FOREIGN PATENT DOCUMENTS

| | | | | |
|---|---|---|---|---|
| EP | 2206833 | A1 | 7/2010 | |
| JP | 4578574 | B1 | 10/2010 | |
| KR | 101164030 | B1 | 7/2012 | |
| KR | 20170105233 | A * | 9/2017 | |
| KR | 101791389 | B1 * | 11/2017 | |
| KR | 102018078948 | A * | 7/2018 | E01C 13/08 |
| KR | 101890914 | B1 * | 8/2018 | |
| WO | 2014049531 | A2 | 4/2014 | |
| WO | 2016190744 | A1 | 12/2016 | |
| WO | 2016205087 | A1 | 12/2016 | |
| WO | 2017132683 | A1 | 8/2017 | |

OTHER PUBLICATIONS

KIPRIS Machine translation of KR 20170105233A, 2017.*
KIPRIS original document of KR 1020170105233A, 2017.*
PCT/US18/25266 International Search Report dated Jun. 25, 2018.
Global Dossier English Translation of KR101164030.
Extended European Search Report, dated Apr. 9, 2020 and JP 4578574B1 reference translation.
JP 4578574B1 EPO English Machine translation.
Certified human Translation of KR2017-0105233 to Choi.
Densified Biomass as a Fuel Source: A New Pellet for New Possibilities, Wm. Andrew Duncan, Master's Thesis submission, Queen's University, Kingston, ONT, Canada, Jun. 2010.
A Review on Biomass Torrefaction Process and Product Properties for Energy Applications, Jay Shankar Tumuluru et al., Industrial Biotechnology magazine, pp. 384-401, Oct. 2011.
Torrefaction—Wikipedia, https://en.wikipedia.org/wiki/Torrefaction, accessed Oct. 2, 2020.

* cited by examiner

| *Test Surface* | | | *Deltec Vert Deformation* | *Deltec Force Reduction* | *Deltec Energy Restitution* | *ASTM 1292 HIC 1.3m Drop Height* | *ASTM F355 Gmax 1.3m Drop Height* |
|---|---|---|---|---|---|---|---|
| Various Natural Turfs<br>University of Tennessee Center for Athletic Safety | | | 7-11mm | 65-80% | 6-17% | 275-525 | 71-115 |
| *Artificial Turf System* | | | | | | | |
| *Underlayment* | *Turf* | *Infill* | | | | | |
| Brock YSR | 50mm monofilament<br>½" stitch gauge | 90% sand 10% bark<br>Dry | 6.4mm | 63% | 19% | 514 | 86 |
| Brock YSR | 50mm monofilament<br>½" stitch gauge | 90% sand 10% bark<br>Wet | 6.5mm | 58% | 21% | 481 | 88 |
| Brock PBYSR | 50mm monofilament<br>½" stitch gauge | 75% sand layer<br>25% wood particles | 7.5mm | 62% | 30% | 620 | 85 |
| Brock PBYSR | 50mm monofilament<br>½" stitch gauge | 65% sand layer<br>35% rubber layer | 10mm | 70% | 34% | 630 | 72 |

Fig. 4

| System | | | Results | | | | | | | |
|---|---|---|---|---|---|---|---|---|---|---|
| **Turf pile height** | **1/2" stitch, gauge, monofilament** | **Brock Product** | **TEST** | **ASTM F355 Gmax** | **Deltec Vertical Def.** | **Deltec Force Reduction** | **Deltec Engery Restitution** | **TEST** | **ASTM 1292 HIC - 1.3m drop height** | **ASTM 1292 Gmax 1.3m drop** |
| 2.0" (50mm) | 1/2" stitch gauge, monofilament | PowerBase YSR | 90% sand / 10% Organic bark (Wet) | | | | | | | |
| | | | POSITION 1 | | | | | Drop 1 | 493 | 119 |
| **Infill Height** | 33mm | | Drop 1 | 77.0 | 7.30 | 72.00% | 13.10% | Drop 2 | 460 | 119 |
| | | | Drop 2 | 81.0 | 6.80 | 69.80% | 15.90% | Drop 3 | 490 | 120 |
| **Sand Type** | 12-20 Sand | | Drop 3 | 79.0 | 6.80 | 69.40% | 16.60% | Average | 481 | 119 |
| | | | **AV. POS 1** | **80.0** | **6.80** | **69.60%** | **16.25%** | · System drains wet<br>· Virtually identical results between dry and wet conditions | | |
| | | | POSITION 2 | | | | | | | |
| | | | Drop 1 | 87.0 | 6.40 | 64.60% | 13.60% | | | |
| | | | Drop 2 | 94.0 | 5.80 | 61.00% | 17.60% | | | |
| | | | Drop 3 | 97.0 | 5.90 | 60.40% | 18.20% | | | |
| | | | **AV. POS 2** | **95.5** | **5.85** | **60.70%** | **18.00%** | | | |
| | | | POSITION 3 | | | | | | | |
| | | | Drop 1 | 79.0 | 7.60 | 72.20% | 13.10% | | | |
| | | | Drop 2 | 86.0 | 6.80 | 69.70% | 15.90% | | | |
| | | | Drop 3 | 89.0 | 6.90 | 69.30% | 16.60% | | | |
| | | | **AV. POS 3** | **87.5** | **6.85** | **69.50%** | **16.25%** | | | |
| | | | **OVERALL AVERAGE - WET** | **87.7** | **6.5** | **67%** | **17%** | | | |

Fig. 5

| System | | | Results | | | | | | | |
|---|---|---|---|---|---|---|---|---|---|---|
| **Turf pile height** | **1/2" stitch, gauge, monofilament** | **Brock Product** | **TEST** | **ASTM F355 Gmax** | **Deltec Vertical Def.** | **Deltec Force Reduction** | **Deltec Engery Restitution** | **TEST** | **ASTM 1292 HIC - 1.3m drop height** | **ASTM 1292 Gmax 1.3m drop** |
| 2.0" (50mm) | 1/2" stitch gauge, monofilament | PowerBase | 90% sand / 10% Organic bark | | | | | | | |
| | | | POSITION 1 | | | | | Drop 1 | 599 | 131 |
| **Infill Height** | 33mm | | Drop 1 | 95.0 | 6.90 | 63.50% | 15.20% | Drop 2 | 593 | 132 |
| | | | Drop 2 | 104.0 | 6.00 | 58.20% | 20.50% | Drop 3 | 547 | 128 |
| **Sand Type** | 12-20 Sand | | Drop 3 | 107.0 | 6.20 | 57.20% | 21.50% | Average | 580 | 130 |
| | | | **AV. POS 1** | **105.5** | **6.10** | **57.70%** | **21.00%** | | | |
| | | | POSITION 2 | | | | | | | |
| | | | Drop 1 | 98.0 | 6.80 | 62.50% | 15.15% | | | |
| | | | Drop 2 | 105.0 | 6.00 | 58.20% | 20.30% | | | |
| | | | Drop 3 | 100.0 | 6.30 | 57.30% | 21.20% | | | |
| | | | **AV. POS 2** | **102.5** | **6.15** | **57.75%** | **20.75%** | | | |
| | | | POSITION 3 | | | | | | | |
| | | | Drop 1 | 101.0 | 6.50 | 61.60% | 17.10% | | | |
| | | | Drop 2 | 107.0 | 5.60 | 57.50% | 21.40% | | | |
| | | | Drop 3 | 107.0 | 5.80 | 57.10% | 21.90% | | | |
| | | | **AV. POS 3** | **107.0** | **5.75** | **57.40%** | **21.65%** | | | |
| | | | **OVERALL AVERAGE - WET** | **105.0** | **6.0** | **58%** | **21%** | | | |

Fig. 6

| Sand Infill Content (90% by weight) | Organic Infill Content (10% by weight) | Test Interval | Infill Depth | Force Reduction | Vertical Deformation | Energy Restitution | Ball Rebound | Rotational Resistance | HIC | Timescale |
|---|---|---|---|---|---|---|---|---|---|---|
| 27 kg | 3 kg | Pre Lisport Dry | 32 mm | 59% | 7.5 mm | 33% | 0.87 m | 63 Nm - Recheck | Under Test | 1 week |
| | | Pre Lisport Wet | | 60% | 7.6 mm | 31% | 0.85 m | 59 Nm - Recheck | Under Test | |
| | | 5,200 Cycles | 32 mm | 57% | 6.6 mm | 37% | 1.05 m | 28 Nm | HIC@1.3m - 582 | 2.5 days |
| | | 10,200 Cycles | 30 mm | 58% | 6.8 mm | 35% | 1.00 m | 31 Nm | HIC@1.3m - 576 | 2.5 days |
| | | 15,200 Cycles | 30 mm | 60% | 7.0 mm | 32% | 0.95 m | 36 Nm | HIC@1.3m - 602 | 2.5 days |
| | | 20,200 Cycles | | | | | | | | 2.5 days |
| 27 kg | 3 kg | Pre Lisport Dry | 31 mm | 58% | 6.8 mm | 35% | 0.79 m | 52 Nm | HIC@1.3m - 625 | 1 week |
| | | Pre Lisport Wet | | 60% | 7.3 mm | 32% | 0.90 m | 51 Nm | HIC@1.3m - 554 | |
| | | 5,200 Cycles | | | | | | | | 2.5 days |
| | | 10,200 Cycles | | | | | | | | 2.5 days |
| | | 15,200 Cycles | | | | | | | | 2.5 days |
| | | 20,200 Cycles | | | | | | | | 2.5 days |

Fig. 7 as-milled
blockular chips remilled and 20,000
lisport cycles

| Time | Elapsed Time, mins. | Air Temp, °F | Unfilled Turf | Turf + Rubber | Turf + Wood Particles | Notes |
|---|---|---|---|---|---|---|
| 2:40 PM | | | 174 | 181 | 168 | Dry samples allowed to sit in sun ~30 minutes |
| 2:50 PM | 0.0 | | 111 | 104 | 92 | Cold tap water applied, temp measured after 5 min. |
| 3:20 PM | 0.5 | 95 | 136 | 135 | 99 | Full sun |
| 3:50 PM | 1.0 | 90 | 166 | 104 | 100 | Full sun, both samples still had some water on the surface |
| 4:20 PM | 1.5 | 92 | 146 | 111 | 97 | Rubber sample dry, infill 24 still wet |
| 12:30 PM | 21.5 | 89 | 178 | 155 | 108 | infill 24 sample still wet |
| 1:30 PM | 22.5 | 93 | 180 | 162 | 112 | infill 24 sample still wet |
| 2:30 PM | 23.5 | 88 | 136 | 119 | 99 | A cloud blew in overhead during meas. |
| 2:50 PM | 24 | 94 | 167 | 155 | 108 | Full sun, infill 24 sample still wet |
| 1:20 PM | 46.5 | 87 | 174 | 160 | 127 | Full sun, top of infill 24 sample is dry, but is still damp underneath |

Comparison of Evaporative Cooling of Unfilled, Rubber Filled, and Wood Particle Filled Turf

Fig. 16

INFILL FOR ARTIFICIAL TURF SYSTEM

CROSS-REFERENCE TO RELATED APPLICATIONS

This application claims the benefit of International Patent Application No. PCT/US2018/25266, filed Mar. 29, 2018. PCT/US2018/25266 claims the benefit of U.S. Provisional Application No. 62/478,254, filed Mar. 29, 2017; U.S. Provisional Application No. 62/529,543, filed Jul. 7, 2017; and U.S. Provisional Application No. 62/616,858, filed Jan. 12, 2018. This application also claims the benefit of United States Provisional Application No. 62/731,499, filed Sep. 14, 2018; and U.S. Provisional Application No. 62/733,116, filed Sep. 19, 2018. The disclosures of these applications are incorporated herein by reference in their entirety.

BACKGROUND OF THE INVENTION

This invention relates in general to artificial turf systems of the type used in athletic fields, ornamental lawns and gardens, and playgrounds. In particular, this invention relates to artificial turf systems having infill material as part of the upper turf assembly structure.

Artificial turf systems are commonly used for sports playing fields and more particularly for artificial playing fields. Artificial turf systems can also be used for synthetic lawns and golf courses, rugby fields, playgrounds, and other similar types of fields or floor coverings. Artificial turf systems typically comprise a turf assembly and a foundation, which can be made of such materials as asphalt, graded earth, compacted gravel or crushed rock. Optionally, an underlying resilient base or underlayment layer may be disposed between the turf assembly and the foundation. The turf assembly is typically made of strands of plastic, artificial grass blades attached to a turf backing. An infill material, which typically is a mixture of sand and ground rubber particles, may be applied among the vertically oriented artificial grass blades, typically covering the lower half or ⅔ of the blades.

In 1965 artificial turf was introduced in the U.S. as a green carpet made of nylon fibers. A polyurethane padding was laminated to the underside of the carpet to reduce the risk of injuries resulting from an impact with the surface. For most of the next decade little change was made to the original turf design, in spite of a growing number of complaints from teams and players about various injuries occurring on the fields. Synthetic turf carpet was introduced to Europe in 1970. Instead of nylon fibers, it was made of polypropylene. Less expensive than nylon, polypropylene was softer and more skin friendly for the players.

In the late 1970's a second generation synthetic turf system, featuring longer tufts spaced more widely apart, was introduced. Sand was spread between the fibers to hold the synthetic turf blades in an upright position and to create sufficient firmness and stability for the players. The playing characteristics and safety on these fields was not comparable to natural grass, and surface abrasion continued to be a problem.

After the arrival of the artificial turf fields spread with sand, technological advances led to a new type of synthetic turf field, which is currently in use. This turf has even longer fibers which are spaced even further apart in the carpet as compared to the "sand-filled" and "sand-dressed" second generation systems. These fibers are usually made of polyethylene, which is more skin friendly than polypropylene. These fields are spread or "infilled" with various mixtures of silica sand and/or recycled tires (granulated rubber commonly referred to as SBR styrene-butadiene rubber). This third generation system attempts to incorporate shock attenuation properties into the infill material. Variations of the third generation systems include infill materials such as thermoplastic elastomer granules, rubber-coated sand, acrylic coated sand, EPDM granules, and organic materials such as ground coconut husk and cork.

There are multiple negative aspects related to the use of rubber granules as an artificial turf infill material, or as one component of the infill in combination with sand. The rubber granules are created by grinding or fracturing post-consumer automobile and truck tires. The black color and synthetic make-up of the rubber granules absorb solar radiant energy causing the playing surface to become excessively hot. The heat problem is intensified by the synthetic grass polyolefin fibers. Surface temperatures exceeding 170° F. are frequently measured on this type of field. A majority of sports facilities with these types of athletic fields incorporate a cooling system (irrigation). These "cooling" systems are only marginally effective in hot weather conditions. A foul chemical smell emanating from the field surface in hot weather conditions is also a frequent complaint. Ground tire rubber also contains several known carcinogens, for which the health effects are not yet fully understood. By comparison natural sports turf remains relatively cool in comparison to the ambient temperature. Although natural turf requires a greater degree of maintenance as compared to artificial turf, the abundance of sports fields in hot climatic regions are natural.

Disposal of synthetic infill materials, including black rubber granules, is increasingly costly and problematic. A typical full-sized athletic field can contain between 100 to 180 tons of rubber granule infill, which may or may not be mixed with sand. This material is rarely re-installed after the useful life of the synthetic turf, which is typically 8-10 years. Due to extended UV exposure and abrasion, the elasticity of the rubber granules deteriorates, meaning that the material is not suitable for reuse and can only be disposed of in a landfill. Not all landfill facilities will accept rubber granules due to their chemical composition which may result in requiring longer transportation distances for disposal.

There is concern that some of the chemical content of rubber infill produces undesirable effects to the environment, and that the water runoff from rubber infilled systems may negatively affect marine life. Often noted are elevated levels of zinc in runoff water from artificial turf fields with black rubber granules. Other noteworthy issues are that rubber infill is considered dirty and less than ideal as a surfacing material. On these athletic fields, the rubber particles stick to players' clothes due to static electricity, and often make their way into footwear, ear canals and eyes. The rubber particles often splash out of the turf system following impacts, or cleat cutting and dragging. Aesthetically, artificial turf fields with rubber crumb have a less green appearance as compared to natural turf.

There are alternatives to black crumb rubber infill, albeit with increased costs. Imported "organic" infill materials are made up, either exclusively or primarily, from ground coconut husk. One infill material includes a mixture of coconut husk, rice husk to facilitate drainage, and cork particles to prevent over-compaction. These organic infill materials are very lightweight and are installed as a top layer over a sub layer of sand, with the sand being used for ballast and stability. These infill materials are effective at reducing playing surface temperatures and provide a more natural interface between players and surface. However, the practice of installing a layer of underlying sand with a top layer of primarily coconut husk has several disadvantages, including higher purchase price, greater maintenance requirements, excessive wear and rapid evaporation. The currently used organic infill materials are primarily sourced from Indonesia and Europe making the purchase price plus shipping a premium for field installations.

As the direct interface between players and surface, the organic material breaks down under impact into smaller particles resulting in a more compacted layer and reduced depth. This issue is especially acute if the field is used in dry conditions, which causes the organic material to become brittle. To mitigate this problem and prevent excessive wear of the synthetic turf fibers, organic infill requires frequent replacement of the material known as "top dressing". This adds to cost and maintenance efforts.

Organic infill helps maintain lower surface temperatures through evaporation. In order to perform this function the field must be watered regularly. Moisture is absorbed into the organic material, and excess water is drained out of the surface system through the sub layer of sand. The thickness of the organic layer is typically 15-20 mm in depth. In a synthetic turf field this upper organic layer is exposed directly to sunlight. The synthetic turf fibers and the organic material heat up from this exposure. The moisture in the system evaporates, thereby releasing heat and this evaporative cooling helps to maintain a cooler surface. In hot weather conditions, however, this effect may only last a matter of hours. Irrigation is then required to re-hydrate the system.

Pure cork granules have also been used as an infill material in combination with silica sand, either in a mixed or layered arrangement. Cork does provide a degree of cooling benefit relative to ground tire rubber, but flotation, lateral migration, and vertical migration of this infill system have proved problematic during and following a heavy rainfall. Excessive static electricity and excessive infill splash are other problems associated with cork infill.

Examples of other alternative infill materials include rounded silica sand, virgin EPDM rubber granules, thermoplastic elastomer granules (TPE), polyethylene pellets, acrylic coated sand and polyurethane coated SBR granules. Although some of these materials reduce or mitigate the harmful chemicals contained in ground tires, they are costly and do not significantly address the issue of surface heat. The performance of these materials in terms of impact attenuation is also somewhat inferior to rubber granules made from ground tires. Other than sand, these other synthetic infill materials have been used to a limited degree.

Recent studies have shown that head injuries and lower extremity injuries are still more frequent and more severe on traditional 3rd generation synthetic turf fields as compared to those incurred on natural sports turf. Traditional synthetic turf fields degrade over time due to UV exposure, excessive surface temperatures that prematurely age the synthetic fibers, and over-compaction of the infill. The performance and safety values vary greatly between a new synthetic turf field and a field 5 years of age or older.

Pristine natural sports turf is still considered to be the preferred and healthiest playing surface. Relatively cool surface temperatures, ideal purchase and traction, effective impact absorption for safety, and the natural aesthetics are all attributes that make natural grass desirable as compared to synthetic turf. High end, sand-based, natural turf root zones consist primarily of sand for firmness and drainage, with a small percentage of peat and/or silt to stabilize the sand, promote growth and retain moisture. Natural sports turf is however difficult and costly to maintain to a pristine condition, especially when heavily used. Watering, mowing, seeding, aerating, and fertilizing are all required to maintain natural turf. These maintenance aspects of natural turf are exacerbated in certain indoor applications or the indoor environment prevents application of natural turf altogether.

To date, all artificial turf infill materials, as part of a surface system, represent some degree of compromise and disadvantage whether it is temperature, chemical concerns, safety, performance, disposal, maintenance, or cost. Infill material has typically been formulated to provide a resilient or cushioning effect to absorb at least some portion of player impact loads. Some of the materials used, however, create environmental and health effects that are less than desirable. In addition, because of wear and degradation properties, the support and cushioning properties of these infill layers can change adversely over time. Thus, it would be desirable to provide an improved infill material that more closely mimics natural turf impact and performance characteristics.

SUMMARY OF THE INVENTION

This invention relates to an artificial turf assembly that includes artificial grass blades surrounded with and supported by an infill material. The infill material includes sand and additional materials.

An infill material for an artificial turf system is disclosed having a plurality of wood particles. Each particle defines a length dimension greater than a width or a thickness dimension, and each particle length dimension is oriented generally parallel to a grain structure of each particle. The length dimension is in a range of about 1 mm to about 10 mm. The length and one of the width or thickness dimensions defines an aspect ratio within a range of 1:2 to 10:1. Each particle maintains a water absorptive property that permits water to be retained by the particle and released over time to disperse heat from the infill material.

An artificial turf assembly includes a turf carpet having a plurality of spaced apart synthetic grass blades and an infill material dispersed onto the turf carpet between the grass blades. The infill material includes sand and a plurality of wood particles, each particle defining a length dimension greater than a width or a thickness dimension. Each particle length dimension is oriented generally parallel to a grain structure of each particle. The length dimension is in a range of about 1 mm to about 10 mm, and the length and one of the width or thickness dimensions defining an aspect ratio within a range of 1:2 to 10:1. Each particle maintains a water absorptive property that permits water to be retained by the particle and released over time to disperse heat from the infill material.

An artificial turf system includes a turf carpet having a plurality of spaced apart synthetic grass blades attached to a backing layer, an underlayment layer, and an infill material dispersed onto the turf carpet. The underlayment layer is at least partially formed from expanded polyethylene or polypropylene bead material and having a density in a range of 20-90 g/l, and may further be defined in a range of 45-70 g/l. The infill material includes sand and a plurality of wood particles, each particle defining a length dimension greater than a width or a thickness dimension. Each particle length dimension is oriented generally parallel to a grain structure of each particle. The length dimension in a range of about 1 mm to about 10 mm, and the length and one of the width or thickness dimensions defining an aspect ratio within a range of 1:2 to 10:1. Each particle maintains a water absorptive property that permits water to be retained by the particle and released over time to disperse heat from the infill material. The turf carpet and infill material disposed onto the turf carpet define a first spring rate and the underlayment layer defines a second spring rate that is more compliant than the first spring rate. In another embodiment, the second spring rate of the underlayment layer is associated with a deflection control layer and the underlayment layer further defines a third spring rate associated with a core section, such that the first spring rate is stiffer than the third spring rate and the third spring rate is stiffer than the second spring rate. In yet another embodiment, the underlayment layer includes a plurality of projections disposed across an upper support surface of the underlayment in contact with the turf carpet.

Various aspects of this invention will become apparent to those skilled in the art from the following detailed description of the preferred embodiment, when read in light of the accompanying drawings.

BRIEF DESCRIPTION OF THE DRAWINGS

FIG. 4 is a data table showing impact test results for an embodiment of a turf system in accordance with the invention when tested in a dry condition.

FIG. 5 is a data table showing impact test results for an embodiment of the turf system in accordance with the invention when tested in a wet condition.

FIG. 6 is a data table showing impact test results for another embodiment of a turf system in accordance with the invention having an alternative underlayment configuration.

FIG. 7 is a data table showing parameters and certain results of endurance testing of an embodiment of a turf system.

FIG. 16 is a data table showing the evaporative cooling effect of one embodiment of wood particle infill.

DETAILED DESCRIPTION OF THE PREFERRED EMBODIMENT

Figure 1:
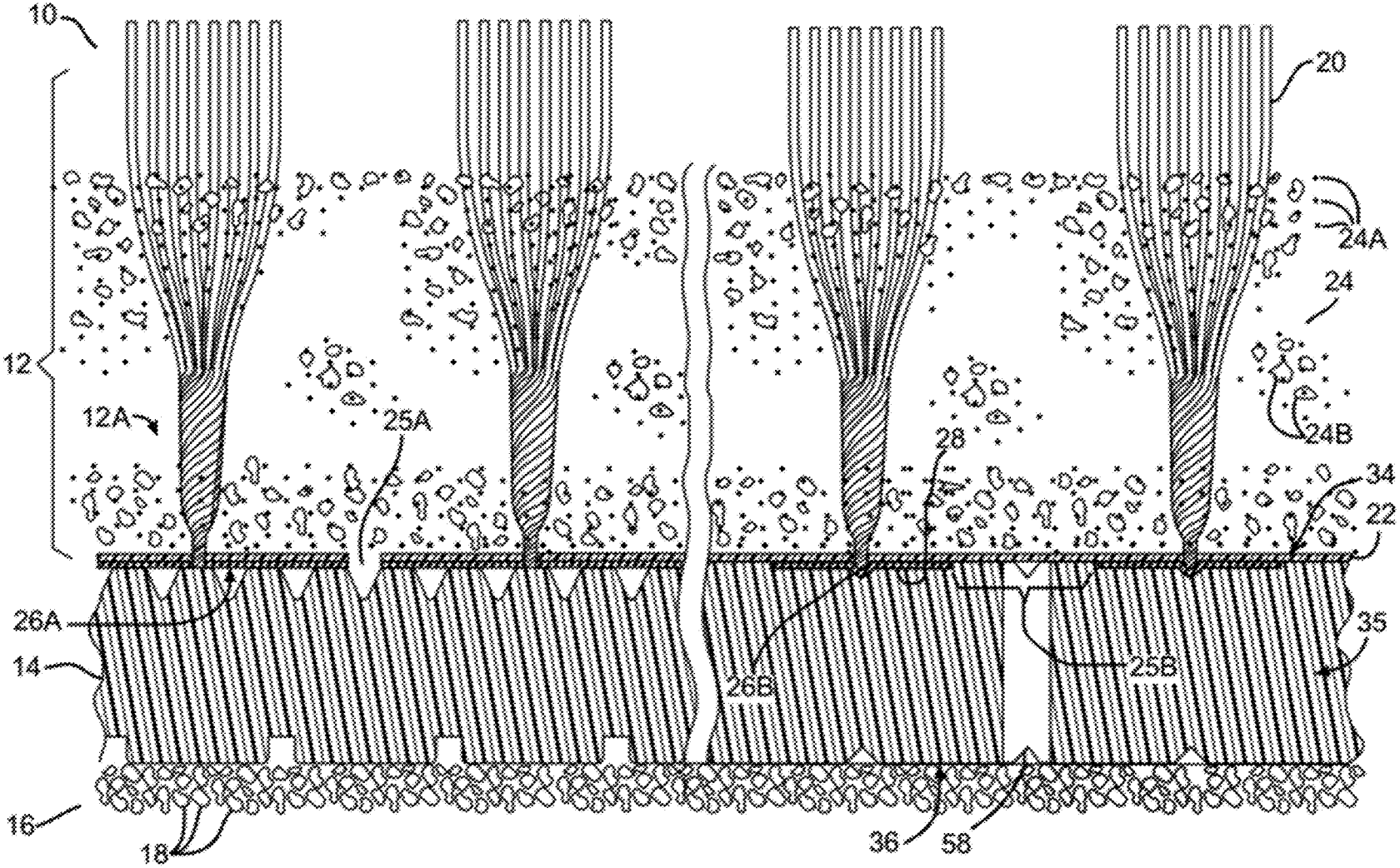
FIG. 1 is a schematic cross-sectional view in elevation of an artificial turf system.

The turf system shown in FIG. 1 is indicated generally at 10. The turf system includes an artificial turf assembly 12, an underlayment layer 14 and a foundation layer 16. The foundation layer 16 can comprise a layer of crushed stone or aggregate 18, or any other suitable material. Numerous types of foundation layers are known to those skilled in the art. The crushed stone layer 18 can be laid on a sub-base, such as compacted soil, a poured concrete base, or a layer of asphalt paving (not shown). Alternatively, the underlayment layer 14 may be applied over the asphalt or concrete base, omitting the crushed stone layer, if so desired. In many turf systems used for an athletic field, the foundation layers are graded to a contour with the goal that water will drain to the perimeter of the field and no water will pool anywhere on the surface.

The artificial turf assembly 12 includes a turf carpet 12A having strands of synthetic grass blades 20 attached to a turf backing 22. An infill material 24 is applied to the grass blades 20. The infill material according to the invention includes sand particles 24*a*, which may be of a generally wide variety and type, and a wood particulate 24*b*, which can be provided in a layered arrangement over the length of the grass blades 20 or as a mixture. As used herein, the terms "wood particulate" and "wood particle" refer to the constituent of the infill material having properties, dimensions, and characteristics associated with compaction; water absorption, retention and controlled release; and durability or controlled break-down along grain lines associated with the length dimension of these "particles." Particles of wood having a size configuration, particularly of width and thickness to length dimensions, outside of the disclosed ranges are intended by way of the invention to wear or otherwise be formed into the claimed ranges of "wood particles" such that the characteristic properties of the infill material are maintained over a prolonged period of time and use. Other constituent materials may also be included and may also be in a particulate form though not functioning as a "wood particle", as will be explained below in detail. The synthetic grass blades 20 can be made of any material suitable for artificial turf, many examples of which are well known in the art. Typically, the synthetic grass blades are about 50 mm in length, although any length can be used. The blades 20 of artificial grass are securely placed, woven, or tufted onto the backing 22. One form of blades that can be used is a relatively wide polymer film that is slit or fibrillated into several thinner film blades after the wide film is tufted onto the backing 22. In another form, the blades 20 are relatively thin polymer films (monofilament) that look like individual grass blades without being fibrillated. Both of these can be colored to look like blades of grass and are attached to the backing 22.

The backing layer 22 of the turf assembly 12 is typically water-porous by itself, but is often optionally coated with a water-impervious coating 26A, such as for example polyurethane, to secure the turf fibers to the backing. In order to allow water to drain vertically through the backing 22, the backing can be provided with spaced apart holes 25A. In an alternative arrangement, the water impervious coating is either partially applied, or is applied fully and then scraped off in some portions, such as drain portion 25B, to allow water to drain through the backing layer 22. The blades 20 of grass fibers are typically tufted onto the backing 22 in rows that have a regular spacing, such as rows that are spaced about 4 millimeters to about 19 millimeters apart, for example. The incorporation of the grass fibers 20 into the backing layer 22 sometimes results in a series of spaced apart, substantially parallel, urethane coated corrugations or ridges 26B on the bottom surface 28 of the backing layer 22 formed by the grass blade tufts. Ridges 26B can be present even where the fibers are not exposed.

The infill material 24 of the turf assembly 12 is placed in between the blades 20 of artificial grass and on top of the backing 22. The infill material 24 is applied in an amount that covers a bottom portion of the synthetic grass blades 20 so that the top portions of the blades stick out above the infill material 24. Typically, the infill material 24 is applied to add stability to the field, improve traction between the athlete's shoe and the play surface, and to improve shock attenuation of the field.

The turf underlayment layer 14 is comprised of expanded polyolefin foam beads, which can be expanded polypropylene (EPP) or expanded polyethylene (EPE), or any other suitable material. The foam beads are closed cell (water impervious) beads. In one method of manufacture, the beads are originally manufactured as tiny solid plastic pellets, which are later processed in a controlled pressure chamber to expand them into larger foam beads having a diameter within the range of from about 2 millimeters to about 5 millimeters. The foam beads are then blown into a closed mold under pressure so they are tightly packed. Finally, steam is used to heat the mold surface so the beads soften and melt together at the interfaces, forming the turf underlayment layer 14 as a solid material that is water impervious. Other methods of manufacture can be used, such as mixing the beads with an adhesive or glue material to form a slurry. The slurry is then molded to shape and the adhesive cured. The slurry mix underlayment may be porous through the material thickness to drain water away. This porous underlayment structure may also include other drainage feature discussed below. The final EPP material can be made in different densities by starting with a different density bead, or by any other method. In one embodiment, the density range of the underlayment layer 14 is in a range of about 20 grams/liter to about 90 grams/liter. In another embodiment, the final EPP material may have a density in a range of about 45 grams/liter to about 70 grams/liter. In another embodiment, the range is 50 grams/liter to 60 grams/liter. The material can also be made in various colors. The resulting underlayment structure, made by either the steam molding or the slurry mixing processes, may be formed as a water impervious underlayment or a porous underlayment. These resulting underlayment layer structures may further include any of the drainage, deflection, and interlocking features discussed below.

In an alternative embodiment, the turf underlayment layer may be configured as an extruded pad 114 having a homogenous cross section. The extruded pad may be an extruded foam pad, such as produced by Trocellen GmbH of Troisdorf, Germany. Alternatively, the underlayment layer 114 may be formed from recycled materials, such as ground rubber from shoe soles, tires, and the like. In one aspect of this embodiment, the ground rubber particles may be bound together in a matrix of elastic polyurethane. The ground, recycled material may take the form of flakes 116 that are packed together, as shown in FIG. 3B. In another aspect, a representative padding may be similar to ProPlay brand padding produced by Schmitz Foam Products B.V. of Roermond, The Netherlands. Such a ground underlayment may be bonded together and exhibit a water impervious characteristic. Alternatively, the flakes forming the ground underlayment may include interstitial voids or drainage holes extending through the pad that allow water to pass through the thickness of the underlayment. The interstitial voids may be formed between adjacent flakes that are, themselves individually, water impervious. Alternatively, the flakes themselves may be porous and may be bonded together such that the underlayment allows water to pass through. In yet another aspect of this embodiment, the pad underlayment 114 may be composed of one or more of extruded crosslinked polyethylene foam, ground and thermally bonded pieces of crosslinked polyethylene foam, and/or ground rubber particles some or all of which may be bound together in a matrix of elastic polyurethane. In yet another alternative embodiment, the flakes may be formed of heat bonded, linear, low density, polyethylene foam.

Figure 3A:
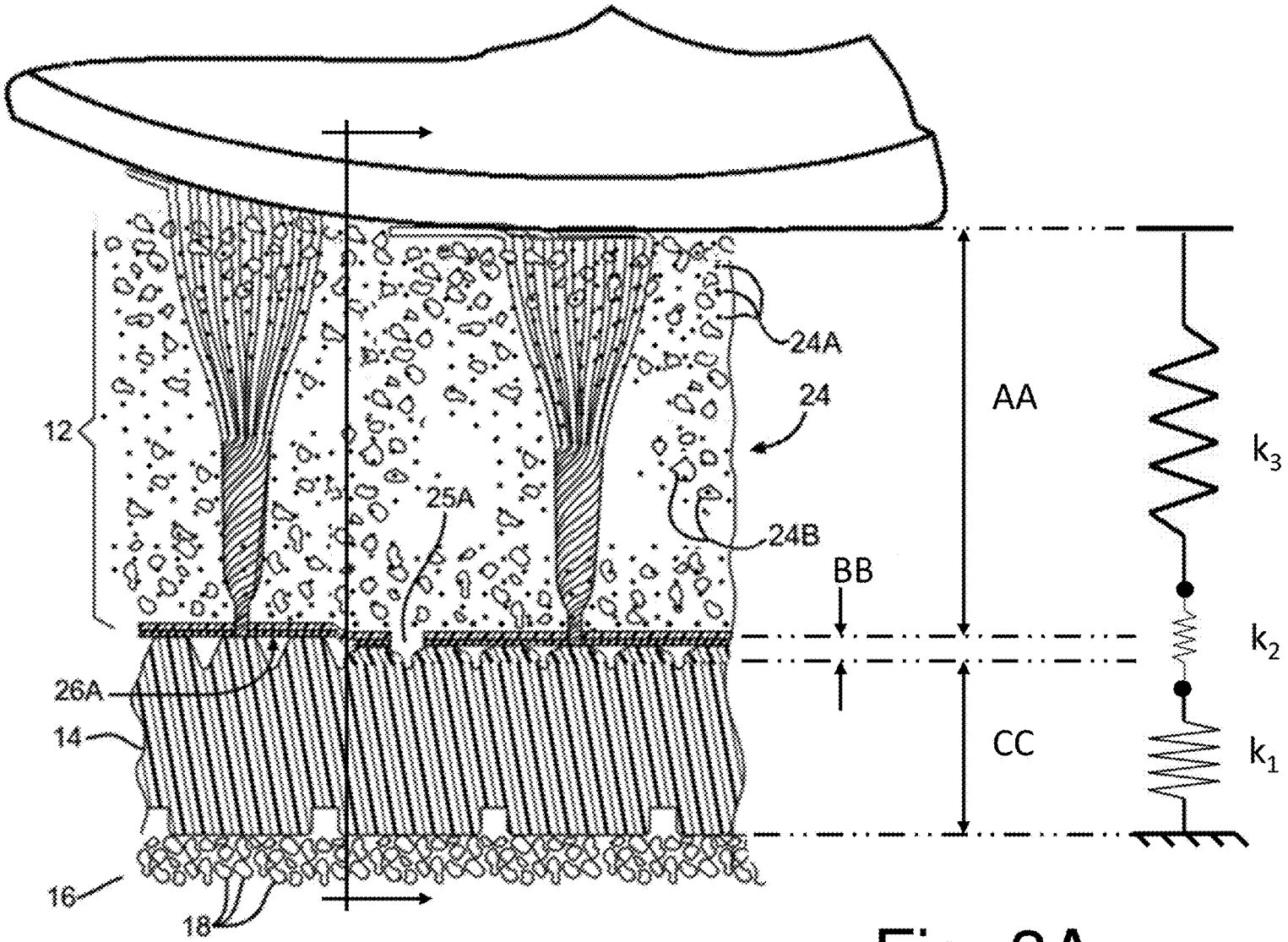
FIG. 3A is a cross-sectional, elevational view of an embodiment of a turf system in accordance with the invention illustrating a system deflection response to an applied load.
Figure 3B:
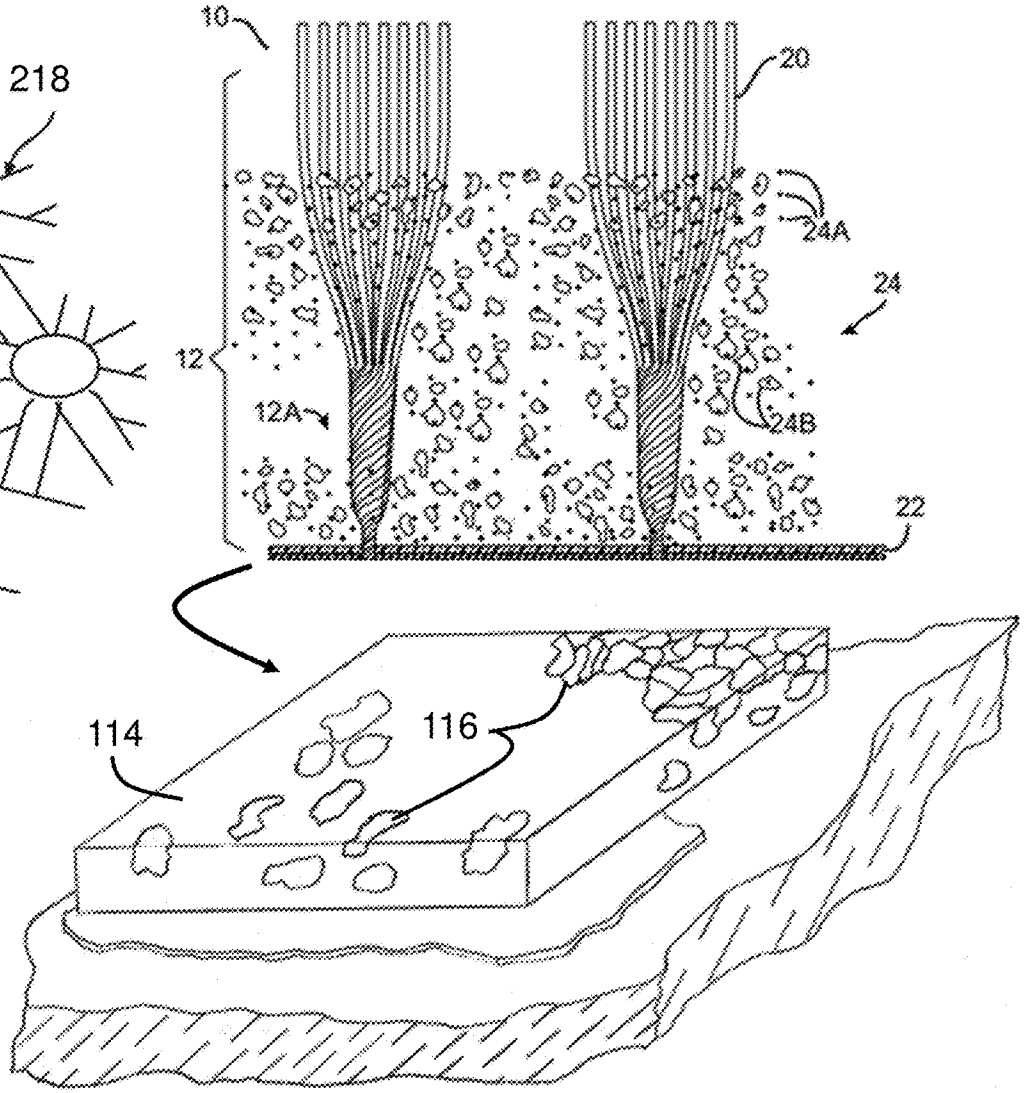
FIG. 3B is a perspective view of an alternate form of a turf underlayment layer.
Figure 3C:
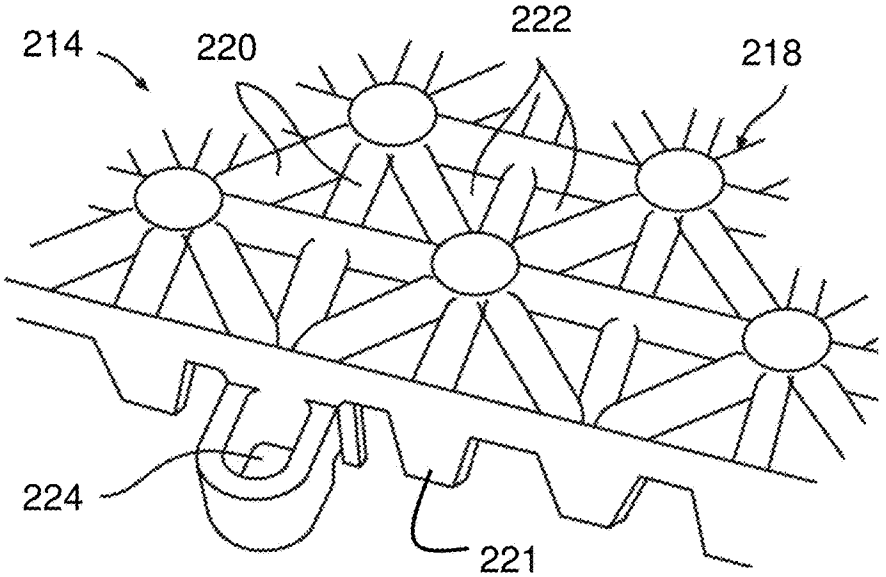
FIG. 3C is a perspective view of yet another alternate form of a turf underlayment layer.
Figure 8:
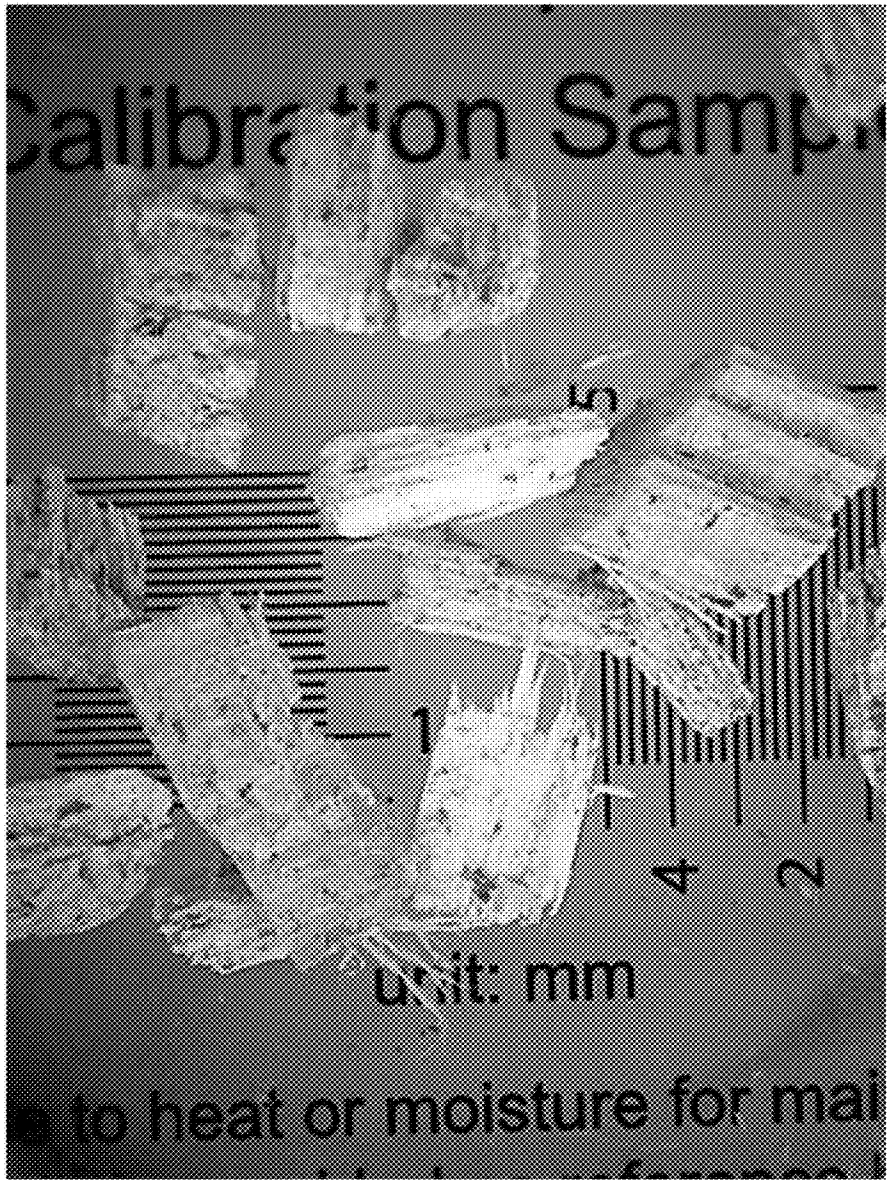
FIGS. 8-11 are photographs showing the shape and size ranges of the wood particle component of the infill material before and after testing.
Figure 9:
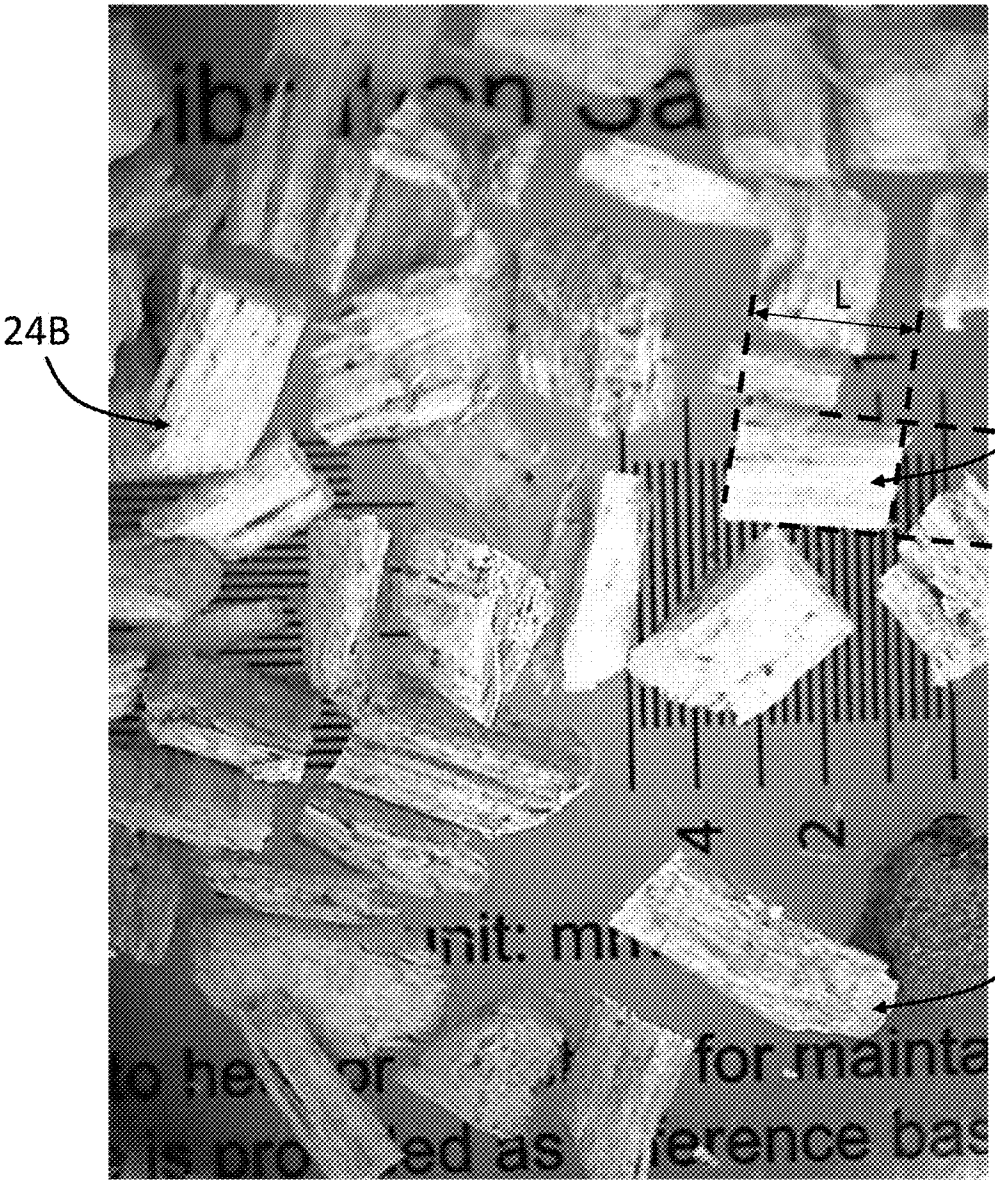
Figure 10:
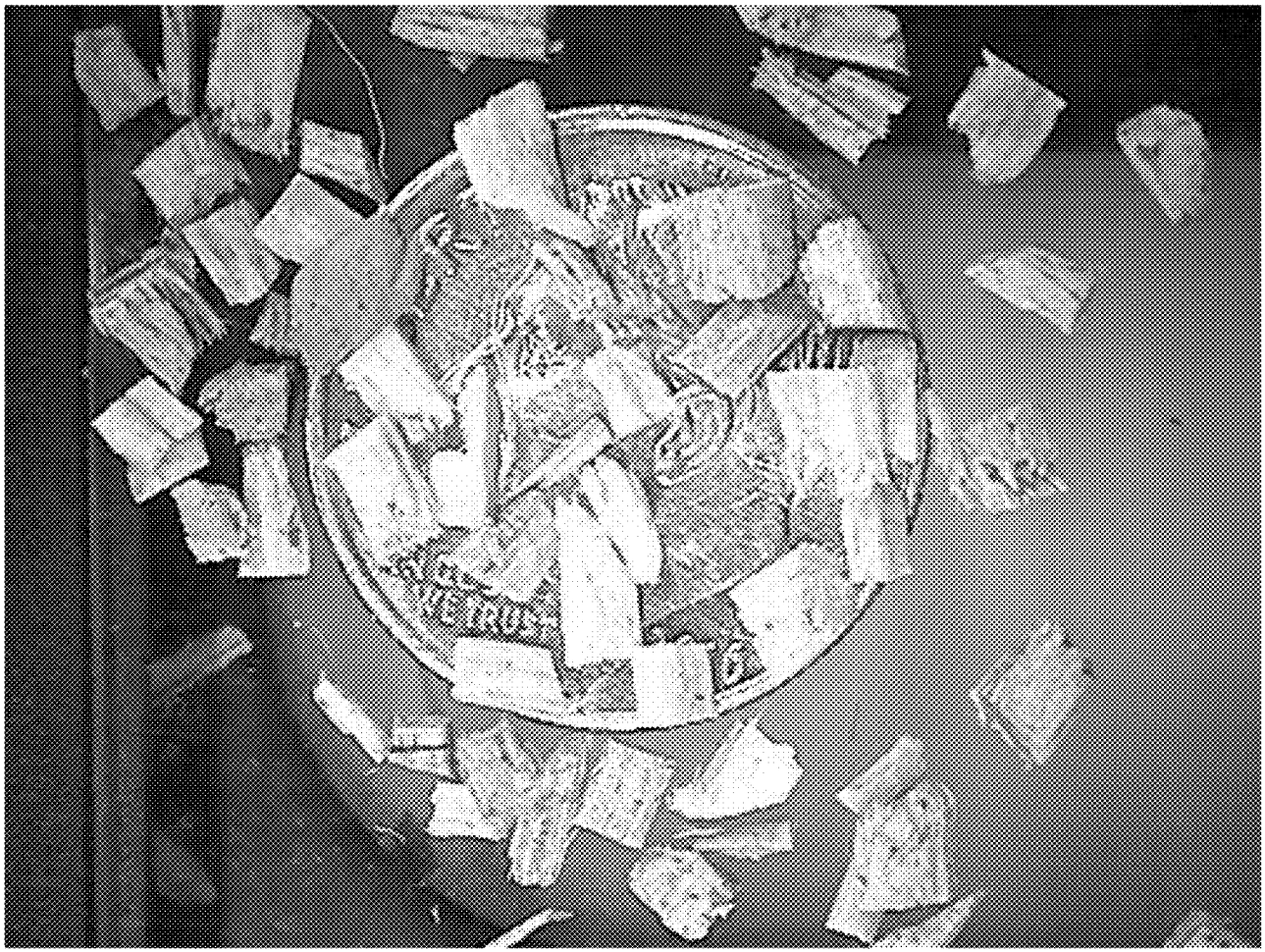
Figure 11:
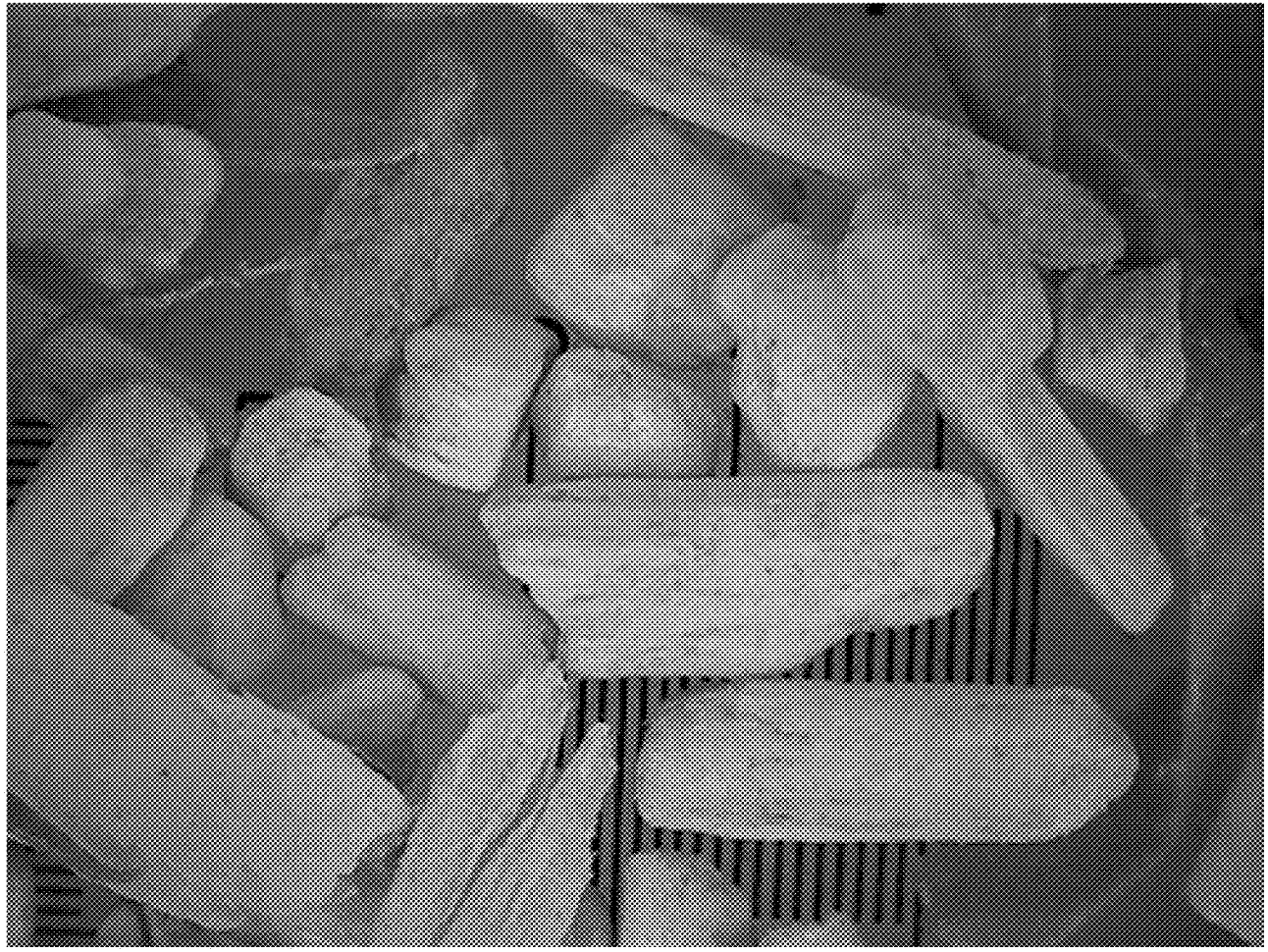

As shown in FIG. 3C, the underlayment layer may further be a molded plastic support porous grid layer 214 can be used. The molded plastic porous grid includes a lattice network 218 formed by elements 220. The elements 220 may be configured as beam elements that are flexible to provide resiliency by the flexing of beams 220 and columns 221 of molded plastic underlayment. The network 218 includes openings 222 for the flow of fluid. Attachment connections 224 can optionally be provided to connect multiple panels. Alternatively, the grid layer 214 may be other than as specifically shown. One such layer may be the VersaTile brand pallet-tiles produced by FieldTurf, a division of Tarkett SA. It is to be understood that the polymeric material of the underlayment support layer can take many different forms.

The ability to tailor the load reactions of the underlayment, the turf, and the infill material as a complete artificial turf system requires consideration and adjustment of competing design parameters, such as a bodily impact characteristic, an athletic response characteristic, and a ball response characteristic. The bodily impact characteristic relates to the turf system's ability to absorb energy created by player impacts with the ground, such as, but not limited to, for example tackles common in American-style football and rugby. The bodily impact characteristic is measured using standardized testing procedures, such as for example ASTM-F355 in the U.S. and EN-1177 in Europe. Turf systems that are designed to a softer or more impact absorptive response tend to protect better against head injury but offer diminished or non-optimized athlete and ball performance. This is particularly true in systems using resilient infill.

The athletic response characteristic relates to athlete performance responses during running and can be measured using a simulated athlete profile, such as the Advanced Artificial Athlete. Athlete performance responses include such factors as turf response to running loads, such as heel and forefoot contact and the resulting load transference. The turf response to these running load characteristics can affect player performance and fatigue. Ball response to a particular turf system may include variations in ball bounce height depending on the firmness of the surface; ball roll, which is affected by the friction of the ball against the turf fibers and infill material; and ball spin, which is affected by the way the ball slips or grips against the infill material, compacted vs. loose, as it bounces on the turf.

The underlayment layer and the turf assembly each has an associated energy absorption characteristic, and these are balanced to provide a system response appropriate for the turf system usage and for meeting the required bodily impact characteristics and athletic response characteristics.

In order to accommodate the particular player needs, as well as satisfying particular sport rules and requirements, several design parameters of the artificial turf system may need to be varied. The particular sport, or range of sports and activities undertaken on a particular artificial turf system, will dictate the overall energy absorption level required of the system. The energy absorption characteristic of the underlayment layer may be influenced by changes in the material density, protrusion geometry and size, panel thickness and surface configuration. These parameters may further be categorized under a broader panel material factor and a panel geometry factor of the underlayment layer. The energy absorption characteristic of the turf assembly involves properties of the infill material, such as material compaction, water absorption and retention, particulate breakdown, and depth. The infill material may comprise a mixture or separate layers of sand and synthetic or organic particulate in a ratio to provide proper synthetic grass blade exposure, water drainage, stability, and in some cases energy absorption.

As shown schematically in FIG. 3A, these characteristics may be understood as springs in series. As shown in FIG. 3A, the underlayment layer 14 defines a spring rate $k_1$ through a core section, identified as zone CC, and a spring rate $k_2$ associated with a deformation control layer, that may include a deformation structure such as the projections, of zone BB. Alternatively, zone BB may be a material layer without projections but exhibiting the spring rate $k_2$. Such a layer associated with zone BB may be integrally formed with the core section CC or applied onto the core section CC. The turf assembly 12 defines a spring rate $k_3$ which acts through zone AA in response to the applied loads, such as impact loads or running loads as illustrated. Each spring schematic represents a portion of the response characteristic of the layer and may further be characterized by one or more springs, in series or in parallel, within each layer. A damping component may also be included in the layer characterizations. The infill 24 provides a substantially stiffer apparent spring constant value $k_3$ to the spring representing the turf assembly 12 than would be associated with more resilient infill compositions, such as those including rubber-based materials. The infill 24 is stiffer when loaded in compression in an impact, such as the impact event in a player being tackled, to permit load transfer to the underlayment layer 14 where properties of the underlayment structure and materials dominate the reactive force returned to the player. In one embodiment, the relative spring rates and stiffness of corresponding sections, indicated from stiffer to more compliant, is preferably ordered as $k_3>k_1>k_2$, where the underlayment section having the surface contacting the turf carpet is more compliant than the turf assembly or the underlayment core, as shown in FIG. 3A. From a macroscopic perspective, the infill 24 provides a load transfer to the underlayment layer similar to compacted sand. However, the wood particulate 24*b* does not compact like sand when analyzed at a particle-to-particle interaction level. Instead, the particles 24*b* maintain the ability of limited movement relative to each other because of the size, particulate dispersion and interactions, and grain orientation of the wood particulate 24*b*. The particle firmness and limited movement of individual particles provide a feel of natural turf, even with surface irregularities that are the result from athletic activity. Rubber-based resilient infills, on the other hand, tend to highlight these surface irregularities causing a lack of assured footing to an athlete.

Because of the size, aspect ratio, and grain orientation, the particle movement differs from a granular particle, such as sand. Sand particles will compact and form a structure much like stones stacked to form a wall. The wood particles 24*b* will orient themselves in a more random configuration where stiffness properties through the thickness provide load transfer to the underlayment yet the shear properties permit some twisting movement, such as cleats engaging the infill surface, without loss of traction, such as an athlete abruptly changing direction. The wood particulate 24*b* is of a size that particle interactions provide a sufficient foothold grip to support tractive effort but enough relative movement to prevent cleats from sticking in place, causing ankle, leg and hip related strains and injuries. The grain orientation relative to the length dimension of the particle 24*b* permits localized particulate deflection without fragmentation into small chunks or pieces of a granular size and shape.

The turf assembly 12 also provides the feel of the field when running, as well as ball bounce and roll in sports such as soccer (football), field hockey, rugby, and golf. The turf assembly 12 and the turf underlayment layer 14 work together to get the right balance for firmness in running, softness (impact absorption or energy absorption) in falls, ball bounce and roll, etc. To counteract the changing field characteristics over time, which affect ball bounce and the roll and feel of the field to the running athlete, in some cases the infill material may be maintained or supplemented by adding more infill, and by using a raking machine or other mechanism to fluff up the infill so it maintains the proper feel and impact absorption.

The hardness of the athletic field affects performance on the field, with hard fields allowing athletes to run faster and turn more quickly. This can be measured, for example in the United States using the ASTM F3189-17 test standard, and in the rest of the world by FIFA, IRB (International Rugby Board), FIH (International Hockey Federation), and ITF (International Tennis Federation) test standards. In the United States, another characteristic of the resilient turf underlayment layer 14 is to provide increased shock attenuation of the infill turf system by up to 20 percent during running heel and running forefoot loads. A larger amount of attenuation may cause athletes to become too fatigued, and not perform at their best. It is believed by some that the threshold of perception by an athlete to turf stiffness variation as compared to a natural turf stiffness (at running loads based on the U.S. tests) is a difference in stiffness of plus or minus 20 percent deviations. The FIFA test requirement has minimum and maximum values for shock attenuation and deformation under running loads for the complete turf/underlayment system. Artificial turf systems with shock attenuation and deformation values between the minimum and maximum values simulate natural turf feel.

Impact energy absorption is measured in the United States using ASTM F355-A and F355-E which give ratings expressed as Gmax (maximum acceleration in impact) and HIC (head injury criterion). The head injury criterion (HIC) is used internationally. There may be specific imposed requirements for maximum acceleration and HIC for athletic fields, playgrounds and similar facilities.

Figure 17:
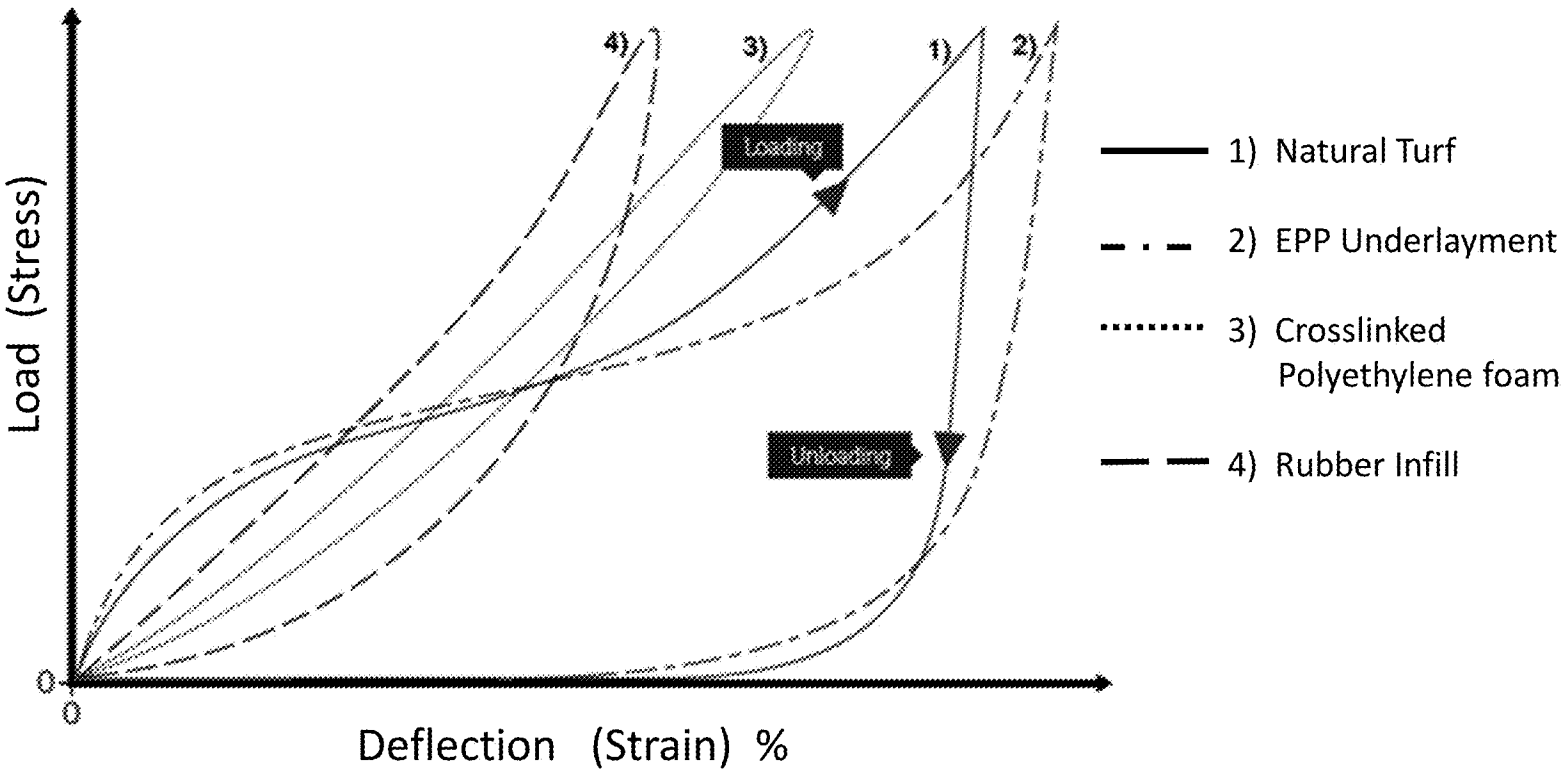
FIG. 17 is a graph comparing the stress/strain response curve profiles of underlayment materials and rubber infill to natural turf.

The turf assembly 12 using the wood particulate 24*b* as a constituent element is advantageous in that in one embodiment it is somewhat slow to recover shape when deformed in compression. This is beneficial because when an athlete runs on a field and deforms it locally under the shoe, it is undesirable if the play surface recovers so quickly that it "pushes or springs back" on the shoe as it lifts off the surface. This spring-back effect provides unnatural energy restoration to the shoe. By making the turf assembly 12 have the proper recovery, the field will feel more like natural turf which doesn't have much resilience. The turf assembly 12 can be engineered to provide the proper material properties to result in the beneficial limits on recovery values. The turf assembly 12 can be designed to complement specific turf designs for the optimum product properties. As is shown in FIG. 17, the response curves of various artificial turf assembly components are compared to the response of a natural turf field. While the magnitudes of the response curve values are not represented and therefore are not directly comparable, the profiles of these curves show how each material responds as compared to natural turf. The curve of the EPP underlayment material of curve 2 exhibits a similar hysteresis and stress/strain profile as a natural turf field of curve 1. This is contrasted with the elastic response curve of underlayment pads made of cross-linked polyethylene foam, shown in curve 4, which does not exhibit the same hysteresis and associated recovery time-delay and material dampening response to running loads.

The design of the overall artificial turf system 10 establishes the deflection under running loads, the impact absorption under impact loads, the shape of the deceleration curve for an impact event, and the ball bounce and roll performance. These characteristics can be designed for use over time as the field ages, and the infill becomes more compacted, which makes the turf layer stiffer.

The panels 30 are designed with optimum panel compression characteristics. The whole panel shape is engineered to provide stiffness in bending so the panel doesn't flex too much when driving over it with a vehicle while the panel is lying on the ground. This also assists in spreading the vehicle load over a large area of the substrate so the contour of the underlying foundation layer 16 won't be disturbed. If the contour of the foundation layer 16 is not maintained, then water will pool in areas of the field instead of draining properly.

In one embodiment of the invention, an artificial turf system for a soccer field is provided. First, performance design parameters, related to a system energy absorption level for the entire artificial turf system, are determined for the soccer field. These performance design parameters are consistent according to the FIFA (Federation Internationale de Football Association) Quality Concept for Artificial Turf, the International Artificial Turf Standard (IATS) and the European EN15330 Standard. Typical shock, or energy, absorption and deformation levels from foot impacts for such systems are within the range of 55-70% shock absorption and about 5 millimeters to about 11 millimeters deformation, when tested with Advanced Artificial Athlete (EN14808, EN14809). Vertical ball rebound is about 60 centimeters to about 100 centimeters (EN 12235), Vertical Water Permeability is greater than 180 mm/hr (EN12616) along with other standards. Other performance criteria may not be directly affected by the underlayment performance but are affected by the overall turf system design. The overall turf system design, including the interactions of the underlayment may include surface interaction such as rotational resistance, ball bounce, slip resistance, and the like. In this example where a soccer field is being designed, a performance level for the entire artificial turf system for a specific standard is selected. Next, the artificial turf assembly is designed. The underlayment performance characteristics selected will be complementary to the turf assembly performance characteristics to provide the overall desired system response to meet the desired sports performance standard. It is understood that the steps in the above example may be performed in a different order to produce the desired system response.

In general, the design of the turf system having complementary underlayment 14 and turf assembly 12 performance characteristics may for example provide a turf assembly 12 that has a low amount of shock absorption, and an underlayment layer 14 that has a high amount of shock absorption. In establishing the relative complementary performance characteristics, there are many options available for the turf design such as pile height, tufted density, yarn type, yarn quality, infill depth, infill type, backing and coating. For example, in prior art infill systems one option would be to select a low depth and/or altered ratio of sand vs. rubber infill, or the use of an alternative infill material in the turf assembly. If in this example the performance of the turf assembly has a relatively low specific shock absorption value, the shock absorption of the underlayment layer will have a relatively high specific value. In one embodiment, the infill material 24 having the wood particulate 24*b* as an upper layer and the sand 24*a* as the lower layer provides a generally low shock absorption value to transfer impact loads to the underlayment layer. The infill material 24 having the upper layer wood particulate 24*b* also dampens the restitution or rebounding response of the turf assembly to provide a firmer footing feel to the athlete, particularly during running.

By way of another example having different system characteristics, an artificial turf system for American football or rugby may provide a turf assembly that has a high amount of energy absorption, while providing the underlayment layer with a low energy absorption performance. In establishing the relative complementary energy absorption characteristics, selecting a high depth of infill material in the turf assembly may be considered. Additionally, where the energy absorption of the turf assembly has a value greater than a specific value, the energy absorption of the underlayment layer will have a value less than the specific value.

A dense, uniform, smooth, and healthy natural turfgrass sports field provides familiar and accustomed characteristics for which sports equipment, playing tactics, and rules of play have developed over time for this form of playing surface for outdoor field sports. A thick, consistent, and smooth grass cover provides a benchmark for playing quality and safety, and serves as a comparative standard for stable footing for the athletes, cushioning levels (energy dissipation) from falls, slides, or tackles, and heat transfer (cooling) the playing surface during hot weather. Although relatively firm under the load of an adult running athlete, natural turf surfaces are able to absorb a high degree of impact force through a combination of particle displacement and a crushing of the natural materials. Research tests have shown although firm under foot, a high performance natural turfgrass is able to significantly reduce the risk of a bodily or head injury by effectively dissipating impact energy loads. The infill material 24 having the wood particulate 24*b* provides particle displacement and particle deformation that mimics the natural turfgrass field. As will be explained below, the wood particulate 24*b* has a grain structure oriented generally along a longer dimension of the particle to provide a desired particle deflection in conjunction with water absorption.

Sand is commonly used to construct high performance sports natural turf rootzone systems. Sand is chosen as the primary construction material for two basic properties, compaction resistance and improved drainage/aeration state. Sands are more resistant to compaction than finer soil materials when played upon within a wide range of soil moisture conditions. A loamy soil may provide a more stable surface and enhanced growing media compared to sand. But, under optimal or normal conditions loamy soil will quickly compact and deteriorate in condition if used in periods of excessive soil moisture, such as during or following a rainy season. A properly constructed sand-based natural turf rootzone, on the other hand, will resist over compaction even during wet periods. Even when compacted, sands will retain an enhanced drainage and aeration state compared to native soil rootzones under the same level of traffic. Un-vegetated sand, in and of itself, is not inherently stable; therefore, it is advantageous to use grasses with superior wear tolerance and superior recuperative potential to withstand heavy foot traffic and intense shear forces. Sand does, however, have incredible load bearing capacity; and if a dense, uniform turf cover is maintained, the sand-based system can provide a very stable, firm, smooth, safe and uniform playing surface. A successful sand-based rootzone system is dependent upon the proper selection of materials. The proper selection and gradation of sand, organic amendment, grass species, and underlying gravel is all of importance to the performance of the natural sports turf grass surface.

One commonly employed reference standard for the construction of a high performance sports turf rootzone is the ASTM F2396, "Standard Guide for Construction of High Performance Sand-Based Rootzones for Athletic Fields". This specification describes a natural turf root zone that consists of approximately 95% graded sands and approximately 5% organic materials (e.g. peat) by weight. Another commonly employed standard for the construction of a high performance sports turf rootzone is the USGA Specification to Guide the Construction of Sand Root Zones. This specification describes a natural turf root zone that consists of at least about 90% graded sands and no more than about 10% organic material (e.g. peat) by weight.

To solve problems with the current third generation synthetic turf system, the infill material 24 of the present invention provides an improved natural infill composition modeled after the performance of high-end natural sports turf. As compared to other organic infill systems or synthetic infill materials, the infill composition of the infill material or layer 24 produces a cooler temperature playing surface in hot climatic conditions for an extended period of time. As compared to other organic infill systems, the increased amount of water retention within the system permits extended exposure to heat before fully evaporating the retained moisture. Given the similarity to a natural sports turf performance, the various embodiments of the turf systems incorporating the infill described herein provide the traction and purchase of natural turf. The infill material is compostable as opposed to landfill disposal for synthetic materials. A shock absorbing underlayment prevents over-compaction of the infill to maintain consistent performance properties for the life of the field.

The infill material 24 is filled between synthetic turf fibers creating ballast, firmness, stability, and traction. The energy that is transferred through the infill material 24 is absorbed by a resilient underlayment base to provide impact absorption properties comparable to a high performance sports turf rootzone, as shown in FIG. 3A. Examples of a suitable resilient base or underlayment for synthetic turf sports fields, such as underlayment materials available from Brock International, Boulder, Colo., are well known. The use of a resilient underlayment helps prevent over-compaction of the particulate infill.

Sand can be defined as a naturally occurring granular material composed of finely divided rock and mineral particles. Sand 24*a*, for use as a component of the infill 24, is defined as one or more of the following: Silica sand, silica quartz sand, rounded silica quartz sand, rounded washed silica quartz sand, and rounded washed, graded silica quartz sand and Zeolite. In one embodiment the sand particles 24*a* have a diameter within the range of from about 0.0625 mm (or 1/16 mm) to about 2.0 mm. Optionally, the sand 24*a* can be colored.

The organic component of the infill is the wood particulate 24*b* and is comprised of particles of wood from the heartwood and sapwood portions of hardwood or softwood trees, as will be described below.

In one embodiment, the infill material 24 includes sand 24*a* in an amount within the range of from about 70 to about 98 percent by dry bulk weight, and wood particles 24*b* in an amount within the range of from about 2 to about 30 percent by dry bulk weight. The sand 24*a* and wood particles 24*b* may be layered in the turf, with the sand 24*a* layer on the bottom. Alternatively, the sand 24*a* and wood particles 24*b* may be blended as a mixture. Depending on certain factors, such as the location of the field indoors or outdoors, latitude, rainfall amounts or watering intervals, sun load exposure, and the type of sport or use the field is tailored for other embodiments of the infill material 24 may be about 10 percent wood particulate 24*b* and about 90 percent sand 24*a* by weight. In other embodiments, there may be a greater proportion of sand 24*a*, including up to about 95 percent by weight or about 75 percent by volume. For example, in regions that receive heavy amounts of precipitation and have generally cooler ambient temperatures, less wood particulate 24*b* as a percentage of the total infill may be used since the playing field does not reach high temperatures that would require evaporative cooling from the infill. Similarly, indoor playing fields typically do not receive direct sunlight and have moderate ambient temperatures, thus requiring less wood particulate in the infill. Conversely, in lower latitudes and regions that experience more days of sunshine and hotter ambient temperatures, a greater proportion of wood particulate in the infill would allow the turf system to absorb a greater amount of water during irrigation or precipitation and thus provide evaporative cooling of the playing surface for an extended period of time. In one embodiment the amount of sand 24*a* applied with the infill 24 constitutes about 3 pounds per square foot. In other embodiments the amount of sand 24*a* is within the range of from about 5 to about 8 pounds per square foot. In a particular embodiment, the amount of sand 24*a* is about 6 pounds per square foot. The weight of the sand helps hold down the turf and the underlayment.

By way of example, the thickness of the infill 24, shown in FIG. 3A as zone AA, may be a layered structure of sand 24*a* and wood particles 24*b*. Generally a thicker wood particle layer and thinner sand layer improves the field's drainage and the ability of the field to provide longer periods of evaporative cooling in hot climates. The field also has higher impact absorption due to the mobility of more of the wood particles (than in a thin wood layer infill). In hot climate regions, a ratio of 2:1 sand-to-wood particles (by weight) provides excellent performance for a high level soccer field. A high quality general purpose field may have a 4:1 sand-to-wood particle (by weight) ratio. A general purpose field in wet regions may have a ratio of 5:1 sand-to-wood particles.

Figure 12:
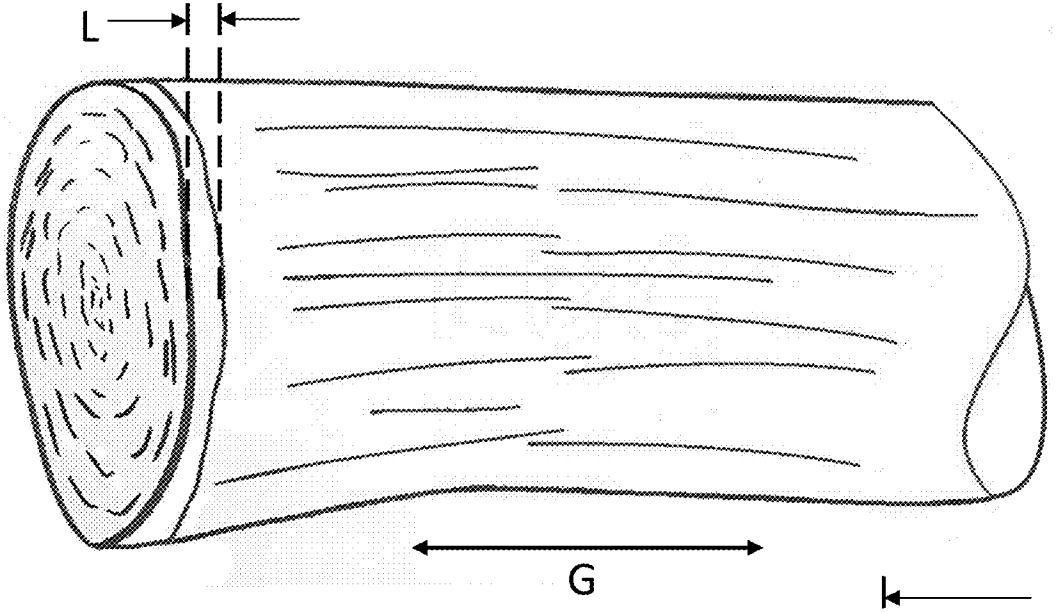
FIG. 12 is a schematic illustration of a log as the source of the infill wood particles showing the relative orientation of the chips prior to formation.
Figure 13:
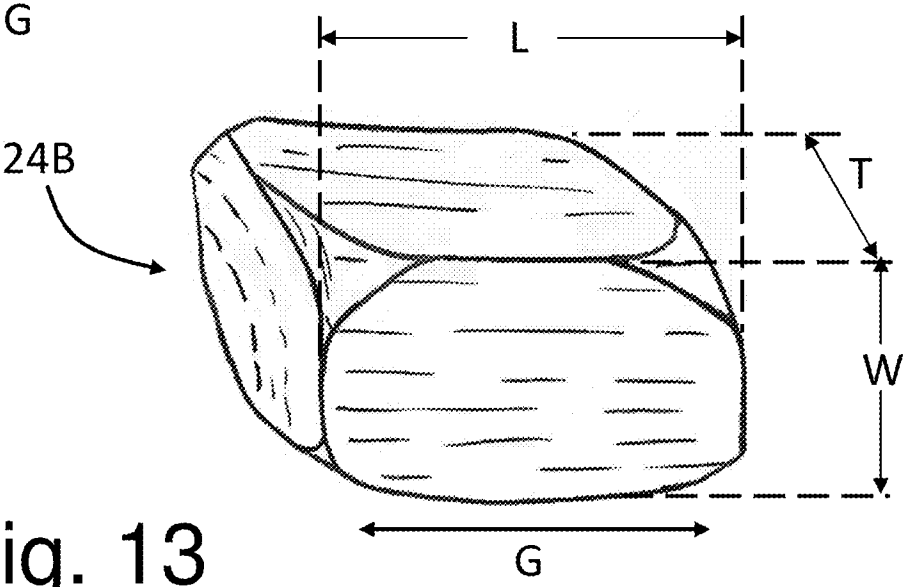
FIG. 13 is a schematic illustration of a chip formed from the log source of FIG. 12.

As shown in FIG. 13, the wood particles 24*b* are generally elongated and have a length, L; a width, W; and a thickness, T. The length, L is in the direction of the grain structure, G of the log from which the particles are formed, as shown in FIG. 12. In one embodiment, the range of the length dimension is about 0.5 mm to about 10 mm. In another embodiment, the length of the wood component particles 24*b* may be within the range of from about 1.0 mm to about 10 mm. In one preferred embodiment, the particle length may be in a range of about 0.5 mm to about 5 mm. An aspect ratio of the wood particles is the ratio of the particle length, L to either the particle width, W or thickness, T. The aspect ratio may be within a range of 1:2 to 10:1. In a preferred embodiment, the aspect ratio (L:W or T) of the particle 24*b* is in a range of 4:1 to 10:1. The width, W and thickness, T dimensions may be in a ratio of about 1:1 to 5:1 and are preferably within a range of about 1:1 to 1.5:1.

The sand/wood infill 24 also mimics the performance, safety, and drainage properties of a sand-based natural turf root zone. The wood component of the infill material 24 improves traction and overall player-to-surface interaction relative to a sand-only infill or sand-synthetic infill material. The sand/wood particle infill 24 provides consistent performance and safety results between dry and wet conditions as determined by ASTM F355, ASTM F1292 and EN 14808 and EN 14809. The sand/wood infill also provides a surface with energy restitution comparable to pristine natural sports turf.

Figure 2:
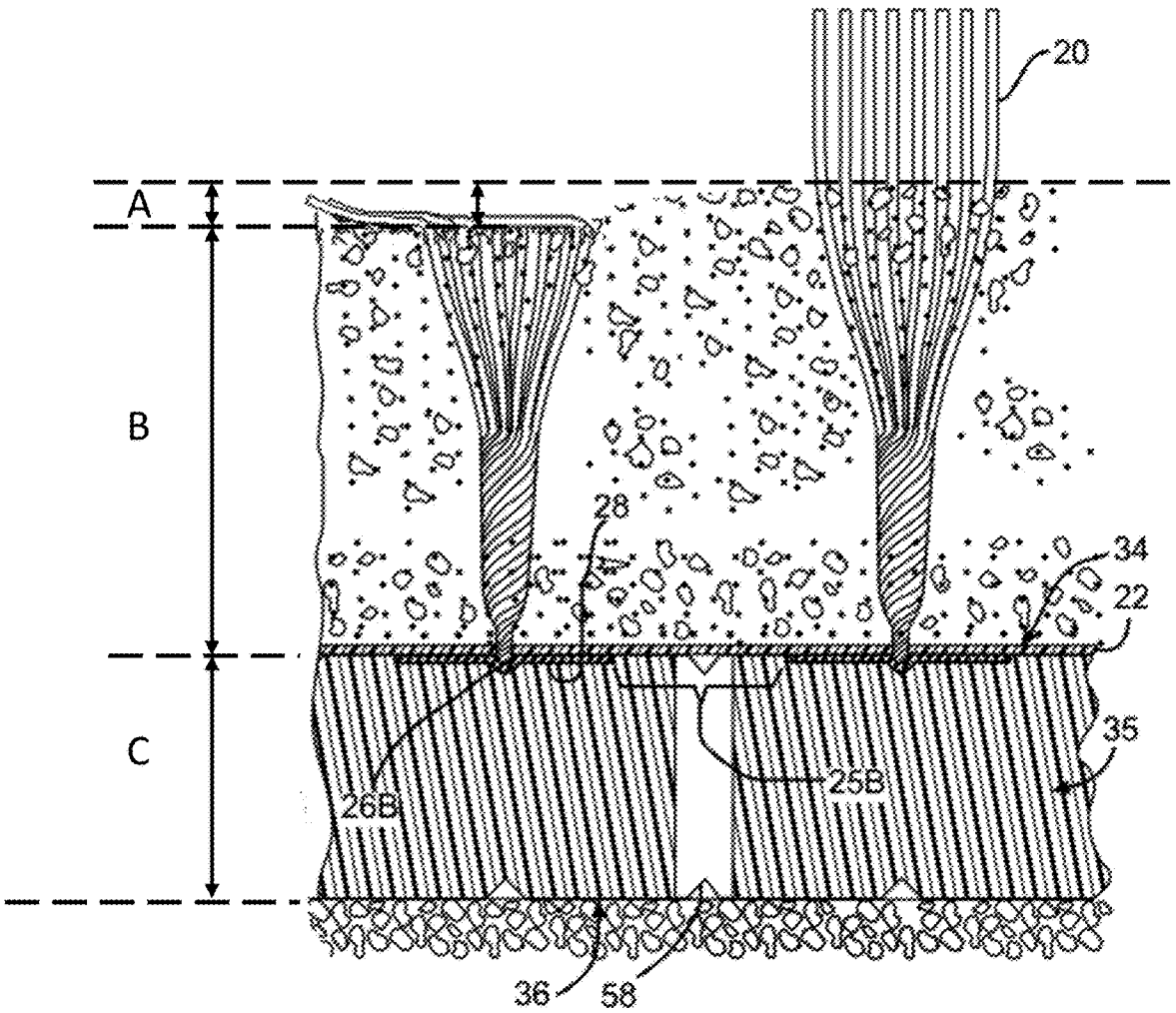
Prior Art Fig. 2
FIG. 2 is a cross-sectional, elevational view of a prior art turf system illustrating an infill material deflection response to an applied load.

In one embodiment the sand/organic infill provides the turf system with a natural turf-mimicking nature. The infill 24 is not as resilient as that provided by conventional sand/ground rubber infill artificial turf systems, but it provides a superior, and more natural, footing response to users of the turf system. The users are more likely to perceive that they are running on a field closely resembling a natural turf field. Thus, the infill material is relatively non-resilient and does not act as a primary impact absorbing layer but rather a load transfer layer. This system for handling load transfer relies primarily on the underlayment layer for the resilient characteristic and for impact attenuation. FIGS. 2 and 3 represent comparative schematic illustrations showing various zones of deflection and load transfer of prior art systems (FIG. 2) and the embodiments of the turf system described herein (FIG. 3A). A comparison of the level of infill deflection of the infill zone A of FIG. 2 shows more deformation under load, providing more impact absorption within the layer but subsequently less load transfer to the underlayment layer, zone B. The infill zone AA of FIG. 3A illustrates the effect of load transfer to the underlayment layer of zone BB, which deforms under the applied load more so than that of the underlayment layers of the prior art.

The sand/organic infill 24 provides a relatively fast drainage system, faster than would be expected with a natural turf system. However, the organic, wood particle component 24*b* has a water retention capability that allows the turf system to dry out slowly once it gets wet. This aspect more closely mimics a natural turf system than would a conventional sand/ground rubber artificial turf system. The composition of sand and organic infill permits a controlled percentage of water to be retained in the infill for some time without the detrimental effect of rotting prematurely.

As a disclosed above, organic infill material can include a mixture of sand and organic material or can applied in layers at the site of the turf field being constructed. The application of the infill mixture or individual components onto the turf can be by a drop spreader or a broadcast spreader, or by any other suitable mechanism.

The organic material used in the infill 24 can include any of the organic materials disclosed above, such as bamboo and cypress, hardwoods such as poplar, and softwoods such as pine and cedar. In a preferred embodiment, the wood particles 24*b* are composed of loblolly pine. The infill 24 can also include other organic materials such as coconut husk, rice husk and cork materials as fillers or inorganic materials such as pearlite or vermiculite to adjust specific turf performance characteristics.

In some embodiments the organic portion, including the wood particles 24*b*, of the infill 24 is designed to mimic the thatch in natural grass. The thatch in natural grass provides excellent traction and rotational resistance involving the rotation of a cleat of an athlete's shoe. The international soccer body, FIFA, has a foot rotation range test for measuring the rotational resistance to rotation of an athlete's shoe. In one embodiment, the artificial turf using the organic infill 24 has a rotational resistance of at least 25 Nm (Newton meters) and no more than 50 Nm under the appropriate FIFA tests, FIFA 10/05-01 and FIFA 06/05-01 Rotational Resistance test. Too little rotational resistance means that the surface is unstable for footing. Too much rotational resistance means that the foot/cleats cannot pivot on the surface (aka cleat lock), which increases the risk of lower extremity injuries. In some of these embodiments the organic materials used in the infill 24, along with the wood particles 24*b*, may also include organic fibrous material, such as hemp, flax, grass, straw, wood pulp, and cotton fibers. In other embodiments synthetic fibrous materials such as polyethylene, can be used.

In certain embodiments, the organic component of the infill 24 is comprised of wood particles 24*b* of different sizes. The smaller particles are intermixed with larger particles, and the different sizes of particles tend to produce a good infill mixture, both from a stability and a durability standpoint.

The infill 24 may be subject to settling, separation, and segregation over time. Several strategies can be used to prevent or retard separation or segregations. In some embodiments, various additives, such as starch or adhesives, or cohesion-enhancing coatings or substances, or polymer emulsions, are used to cause the infill particles, including the wood particles 24*b*, to stick together and to prevent or retard the particles in the infill 24 from segregating by size during storage, transportation, and application to the turf field, and also during use of the turf field after installation. Ideally, the infill particles 24*b* have an affinity for each other, both physically and chemically. Physically, the particles 24*b* may form a network, randomly orienting the length L of particles in various directions. Chemically, the particles 24*b* have an attraction as a result of weak particle-to-particle hydrogen bonds.

It is also advantageous to employ a mechanism to prevent over-compaction of the infill 24. One mechanism that can be used to prevent segregation by size, and to prevent over compaction is to use different shaped particles, i.e., with some of the infill particles having one shape or set of shapes, and other infill particles having other shapes. Other mechanisms to prevent over compaction can be used. Also, having a particle size distribution of infill particles will improve rotational resistance of athletes' shoe cleats. It is desirable to provide infill that acts like a thatch zone in natural turf for shoe cleat rotation. In one embodiment a top dressing layer, different from the underlying infill mixture, is applied as a top infill layer during construction of the turf system.

Conventional turf systems using a sand/ground rubber infill mixture tend to absorb heat, and such systems often experience uncomfortably hot turf surface temperatures during hot, sunny weather. One of the beneficial attributes of a turf system that uses the organic infill 24 is that the infill, and in particular the wood particles 24*b*, will have a natural tendency to act as a moisture reservoir, particularly based on their size and aspect ratio relative to the grain orientation. As moisture is added to the turf, the organic material absorbs the moisture. Later, the moisture evaporates from the infill 24, thereby providing a cooling effect on the turf system. Such a cooling effect is highly advantageous for turf system exposed to hot climates. The field can be cooled off by applying water to the field. Ideally, the turf field is designed to release its moisture slowly so that the cooling effect will occur over a longer period of time. Various physical aspects of the infill 24, and particularly the wood particulate 24*b*, will affect the amount of moisture that can be absorbed by the infill, and the rate at which the moisture is absorbed, and will also affect the rate of evaporative cooling during the release of the moisture during a drying process. The surface area of the particles 24*b* in the infill 24 will affect the amount of moisture that can be absorbed and adsorbed, with a higher moisture content being adsorbed with particles having higher surface area. The use of other fibrous materials can also beneficially affect the absorption qualities of the sand/organic infill 24. Also, an additive, such as a wetting agent can be incorporated into the infill mixture. Other examples include using vermiculate, pearlite (also known as perlite), and Zeolite, as well as other organic and inorganic absorbents including montmorillonite clay and Bentonite. These materials act as a water reservoir by absorbing moisture. In one embodiment, the additive will make the infill mixture more hydrophilic. A wetting agent is particularly helpful in enhancing wetting of the infill mixture when it is first exposed to moisture. Any one or more of the infill materials listed above can act as a filtration agent as well as a hydration agent. The sand/wood infill does not leach harmful chemicals, toxins or impurities.

The geometry, size, and grain orientation of the wood particulate 24*b* aids in water absorption and release while preserving the resistance of the particles to degradation from applied loads and maintaining the desired load transfer characteristics onto the underlayment layer 14. As water is absorbed by the particles 24*b*, the water migrates very quickly along the grain boundaries of cellulose fiber and into the lignin and xylem. Because of the size and aspect ratio of the particles 24*b*, water absorbs quickly which increases the particle density quickly to prevent floatation of particles from the infill 24 during and after rainfall or watering cycles. The quick absorption is due to the high surface area of the particles and the orientation of the grains along the length of the particle 24*b*. This water absorption characteristic impacts the performance properties of the infill 24 and the overall turf assembly 12. As the particles absorb water the coefficient of friction between adjacent particles 24*b* in the infill 24 decreases. This permits particles to more readily move relative to each other. The wet particles resist fracturing but also exhibit decreased mechanical properties, such as strength and bending. While the expectation would be that a reduced coefficient of friction would produce a slippery surface to the artificial turf, the particles improved elasticity and reduced mechanical properties permit particle-to-particle mechanical interactions from geometric shape changes (due to the aspect ratio and size range) that compensate for the lower frictional values. This is possible because the cellulose fibers, though separable along the grain boundaries, are substantially strong in tension. Were the grain boundaries oriented haphazardly or substantially along the short dimensions (W or T), the particles would fracture into a size similar to the sand or ground rubber. They would then become more like greased ball bearings rather than slightly entangled or bent beams.

A particular benefit of increasing the ability of the organic infill 24 to absorb moisture is that in water-scarce geographic locations the amount of water required to keep cool a turf system having an organic infill 24 will be minimized. When designing an artificial turf system that will use an organic infill 24, the amount of sun load and expected ambient temperatures can be taken into account to provide an appropriate amount of evaporative cooling for a comfortable athletic playing surface.

In one particular embodiment, there is provided a system for designing turf systems, where the amount of sun load and expected ambient temperatures are taken into account to provide an appropriate amount of moisture-containing organic material for maintaining hydration at the location of the turf system. Designs for turf systems located in drier and more sunny locations will be provided with an infill mixture having a greater amount of moisture-retaining materials than the infill mixture for turf systems located in locations having more moisture. Further, the infill mixtures for the drier and more sunny locations will be designed with an infill mixture having a slower water release rate than the rate for the infill mixture for turf systems in more moist climates. In this manner the turf system will be tailored to fit the expected prevailing humidity level in the design location.

Other additives can be applied to or incorporated into the infill mixture to achieve additional benefits. One additive is a substance for odor control for artificial turf applications for pet surfaces, such as pet outdoor artificial turf carpets. Such carpets are known as landscape turf. Additives can be employed to treat the organic infill material to retard or prevent decomposition. Further, the infill mixture can be treated with antimicrobial agents to prevent growth of undesirable organic substances. For example, quaternary ammonium compounds may be used to not only provide antimicrobial protection, but also as an antistatic agent to prevent the wood particles from sticking to athletes' clothing.

It can be seen that the artificial turf system having an organic infill 24 can provide a number of advantages. One particular advantage is that the materials will be more readily recyclable than artificial turf systems using ground rubber. Another advantage is that infill composition 24 can be fine-tuned to the meet the particular requirements of any particular artificial turf installation. For example, the infill composition 24 can be designed to provide the best possible footing surface for a particular artificial turf application, such as developing a turf surface for American football, or a turf surface for a soccer field, which would have different footing and bounce (recovery) requirements from that of the American football field. Independently, the underlayment layer, such as a foam underlayment, can be engineered to provide the proper impact response appropriate for the specific turf application. Thus, an engineered artificial turf system can be designed to meet the requirements of any particular application.

In one embodiment the infill 24, which can absorb moisture, has applied to it an environmentally friendly antifreeze composition to keep the infill 24 from freezing solid on a football field during sub-freezing weather. An example of such a material is disclosed in U.S. Pat. No. 7,169,321, the disclosure of which is hereby incorporated by reference.

In another aspect, the concept of maintaining the hydration of the organic infill material is incorporated into the infill material. Organic infill is typically a mixture of fine wood, bark, and wood byproduct particles and may include ground coconut husks, cork, and coconut fiber to produce a free-flowing material that, when placed over sand and worked into the fibers of artificial turf help provide for a playing surface that gives athletes the traction and to a certain extent the feel of natural grass. But today's commercial organic infills require a certain amount of moisture to help them maintain those characteristics. The finer wood particles absorb and release moisture readily, helping give the infill the desired feel. The evaporative cooling of the infill keeps the playing surface from becoming as hot as synthetic turf fields that have incorporated an infill material of sand and ground tire rubber. But because the organic particle size is small (typically much less than one millimeter in diameter), the evaporation of moisture from the interior of the particles is relatively rapid, so the cooling effect provided by the infill is short; on the order of a few hours after the moisture is applied, and not a practical means of cooling the field for athletic play. Also, after the moisture evaporates, the ingredients of most organic infills become friable and are pulverized from the sports activities played on them. The infill loses its resiliency and becomes compacted, making the playing surface harder and less able to provide traction for the athletes.

While not wishing to be bound by theory, research and testing has shown that the sand base applied to the synthetic turf beneath the infill is the rate limiting component for vertical water drainage through the turf system, regardless of the infill material on top of the sand. But with typical organic infills, the fine particles that sift down into the sand layer occupy the voids between sand granules, further impeding the flow of water during rain events. During heavy rainfalls, the field may not be able to percolate all of the water through the infill and turf, causing "ponding" and surface runoff that may wash away the infill to the sidelines.

In another aspect of this invention, the infill combines wood particles from several species of trees, and the particles are of a certain geometry that keeps them from becoming friable and breaking down when subjected to the shearing action of sports play.

The wood particles described in this invention are coarse enough to permit water permeation during heavy rain storms and because they are resistant to mechanical breakdown, they do not form a layer of fines that can impede water flow through the infill layer. Nor are there significant fines to become trapped between grains of the sand layer.

A further configuration of this invention considers a systems approach with the use of a coarse sand layer in conjunction with the organic infill components so as to maximize the water drainage through the sand and reduce the chance of any fine particles becoming lodged in the voids between sand grains.

The wood particles are composed of the heartwood and sapwood of softer woods such as southern yellow pine and western red cedar trees, which are considered ideal due to their relative abundance and resource renewability. But functionally hard woods like poplar may also be used. Unlike other organic infills that may include significant amounts of bark and partially decomposed wood particles that can easily be broken down by mechanical shearing, the wood chip component of the inventive infill is resistant to the abrasion encountered on other artificial sports playing surfaces, including those relying on rubber or coconut husk-based infills. Also, the particles are not as hard as other organic materials like ground nut shells, so they do not have the same abrasive feel against the skin. Wood hardness is measured using the Janka hardness test. Soft woods like southern yellow pine have a Janka hardness of between 500 and 900, while poplar has a Janka hardness of 1100 to 1300. Other species such as hardwoods may be used with Janka hardness measurements of up to 2500. Walnut shells cannot be measured on a Janka test, but are so hard they have been characterized on Moh's hardness scale for minerals to be between 3 and 4. Besides its hardness, walnut shells have more distinct, angular edges than processed wood particles, adding to its abrasiveness.

The wood particles 24*b* may have a range of sizes, from 0.5 mm×0.5 mm up to 5 mm×5 mm in cross section and up to 20 mm in length. In one preferred embodiment the wood particles 24*b* may have a size range of (0.5 to 2 mm)×(0.5 to 2 mm) in cross section and from 0.5-5 mm in length. Wood particles with aspect ratios of 1:2 up to 10:1 are included. The edges of the particles may be well defined as a result of the chipping and milling operations used to produce them or they may be rounded as the result of the severe abrasion that takes place during wood processing. The bark layer of the tree is an undesirable component of the wood particles due to its friability, but is acceptable in quantities of up to about 10%.

The wood particles 24*b* may be sized for specific applications, such as the sport to be played, and playing conditions. For example, a soccer field will benefit from wood particles 24*b* having a length in a range of about 3 mm to about 7 mm. The width and thickness may fall between 0.5 mm and 2.0 mm. The aspect ratio may be in a range of 3:1 to 7:1. Longer particles allow the athletes' cleat to gain purchase as they quickly run and change direction slightly, but when they pivot, the shear forces on the particles cause them to shift and move, similar to the way a natural turf releases under torsional loads. This loading scenario is common for soccer play. For gridiron or American football, the length may be from between greater than about 2 mm and less than about 6 mm. The width and thickness may be between 0.5 mm or 1.0 mm to about 2.0 mm. The aspect ratio may be in a range of about 1:1 to up to 6:1. For football, the particle size distribution is a little narrower to give the infill slightly more mobility and prevent cleat lock under the very high player to player impact forces. For a general use athletic field covering a broad range of sports and activities the wood particle length may be between greater than about 1 mm and less than about 5 mm. The width and thickness may be between 1.0 and 2.0 mm. The aspect ratio is 1:1 up to 5:1. The narrower particle size range makes a firm field for both cleated and flat athletic shoes. Greater load transfer to the shock pad with a more lively ball bounce results in a good playing surface for children's activities and sports like lacrosse.

As a tree grows, the cambium generates mostly longitudinal cells whose lengths are about 100 times longer than their widths. The longitudinal cell walls form the grain that is visible as long parallel lines in wood particles. In one configuration of the infill material the wood particles are manufactured in such a way that the wood particles are elongated, having a longest dimension, and the grain of the wood is oriented in the longest dimension of the particle, as shown in the drawing of a single elongated wood particle. In this configuration, the particles are least susceptible to fracturing when impact, bending, or shearing forces are applied to the infill such as during athletic activity.

The wood particles of this invention are large enough to absorb moisture into the interior of the particles due to precipitation or irrigation, and slowly release the moisture over a period of up to two days. FIG. 16 is a table showing a comparison of turf surface temperatures before and after water was applied to plain unfilled synthetic turf, synthetic turf infilled with sand and rubber, and synthetic turf infilled with sand and wood particles of this invention. The cooling effect of the moisture dissipated quickly on the plain and rubber infilled turf since the applied moisture was only on the surface of those materials. But the wood particles continued to provide evaporative cooling for 48 hours, which makes it a practical means of cooling a sports playing field. Repetitive application of water and subsequent evaporation do not affect the durability of the wood particle infill.

The preferred particle sizes and size distribution provide several functions as synthetic turf infill. The more cubic particles provide bulk to the infill layer and have a limited amount of mobility to fill large voids in the infill once it is applied to the turf and thereby help to stabilize the infill layer. Particles having shapes with higher aspect ratios are able to "knit" together or interlock to a limited degree, which provides superior traction for athletes running on the field as compared with infill materials having more cubic or spherical particle shapes.

Elongated wood particles as described above may also help prevent the infill from becoming compressed as a result of extended playing activity. Depending on how the elongated particles are supported from below, they may, when a vertical load is applied to the turf, act as small springboards or bending beams that deflect under load and recover to their original shape and position when the load is relieved. Although the particles themselves are non-resilient, the ability of the elongated particles to flex under load and recover provides a slight feeling of resiliency during athletic activity, much as a thatch zone in natural turf has a slight feeling of resiliency. This recovery of shape also helps to prevent compaction of the infill layer and maintain its ability to vertically drain water through the turf. Alternatively, a resilient additive may be incorporated into the infill composition to augment the flexure response of the elongated particles in order to prevent over-compaction with extended use. Suitable materials may include one or more portions of crumb rubber, thermoplastic elastomer, ethylene propylene diene monomer, and cork.

Although cellulose and lignin, the primary organic components of wood, have specific gravity greater than 1.0, the specific gravity of dry wood is much less than 1.0 due to the air that displaces water in the wood when it is dried. Therefore, dry wood readily floats in water. But over time, water is absorbed by the cellulose in wood and once the air is displaced within the wood, the wood sinks. The time required for wood to sink in water is, in part, a function of the surface area to volume ratio of the wood. Smaller particles have a higher surface area to volume ratio than larger chips or logs, and absorb water more quickly. The wood infill particles of this invention have surface area to volume ratios as high as 12 $mm^{-1}$ down to about 0.75 $mm^{-1}$ The wood particles of this invention sink in water within as little as two seconds.

Although they are designed specifically for the sports turf performance discussed above, the wood particles have the added and unexpected benefit to sports field owners of being less prone to washing away during heavy rainstorms than other more buoyant organic infills. As rain begins to fall on the wood infilled turf, the water is quickly absorbed by the small wood particles, thus increasing the specific gravity of the particles to more than that of water. If the instantaneous rate of rain falling exceeds the ability of the system to vertically and laterally drain water through and under the turf, water can pool and begin to drain across the turf surface. Buoyant infill is easily carried off by the water and collects along the sidelines of the field, requiring costly and time-consuming replacement of the infill before the field can be used again. The wood particle infill of this invention, having absorbed water such that the wood particles become denser than water, are not washed away by the pooling and surface drainage of water in a heavy rainstorm.

The rapid absorption of water by the wood particles 24*b* does not compromise the slow evaporation of water and resulting cooling effect as the particles dry out. In much the same way that a cellulose sponge rapidly absorbs water but takes a long time to dry out, the tortuous path that water must take from the interior of the wood particles plus the attractive forces between the water molecules and the cellulose in the wood slow the rate of water evaporation from the infill.

Some organic infills are comprised of very small (<<1 $mm^3$) cellulose-based particles including, for example, ground coconut husks. These particles absorb water very quickly, but because their surface area to volume ratio is so high, the moisture evaporates quickly and the cooling effect is short-lived. As discussed above, these dried out particles are friable and are easily pulverized with athletic activity, rendering them useless as an infill.

Cork is another organic infill material that is sometimes used as a replacement for rubber infill in artificial turf sports fields and consists of ground particles that have a high surface area to volume ratio. But cork is a chemically and physically unique organic material that is different from the structural and physical make-up of the infill material 24*b*, particularly related to the shape and structure of the resulting processed particles. About 50% of the air spaces in cork are completely enclosed within the cork matrix, making it resilient, but extremely hard to displace the air with water. Besides cellulose and lignin, which are hydrophilic, the cork matrix contains a lipid molecule called suberin, which is hydrophobic and resists permeation of gases. The physical structure of the cells in cork and the presence of suberin may make cork an ideal material to seal wine in a bottle, but they make cork infill buoyant and susceptible to floating away in heavy rain.

Figure 14:
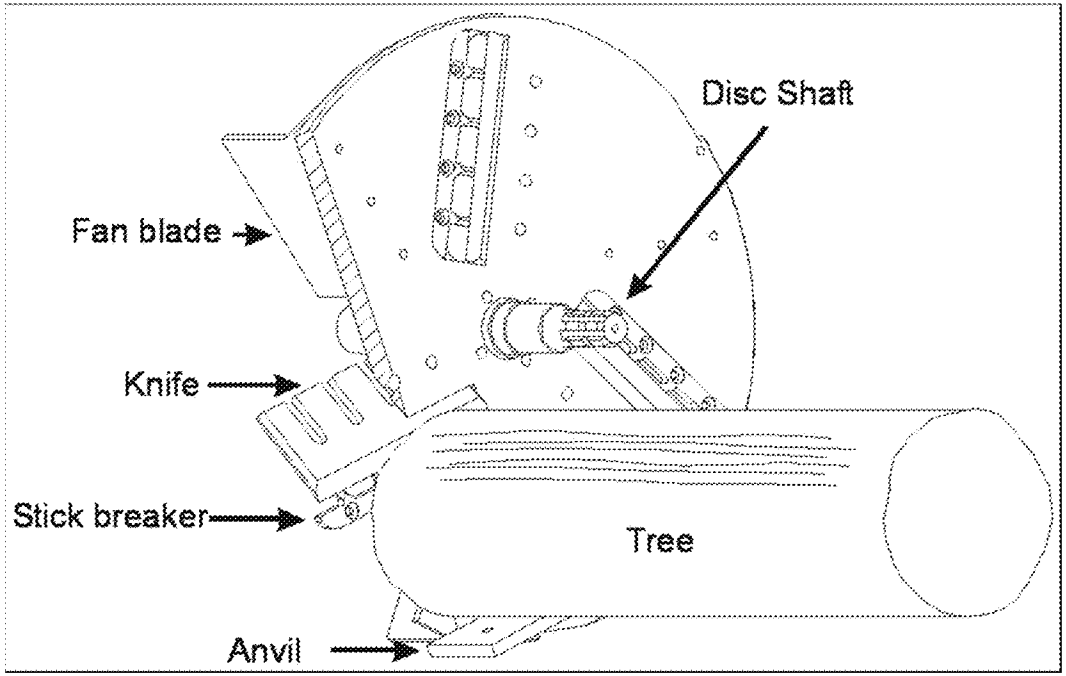
FIG. 14 is a sketch showing the basic operating features of a wood chipper with a disc shaped chipper blade.
Figure 15:
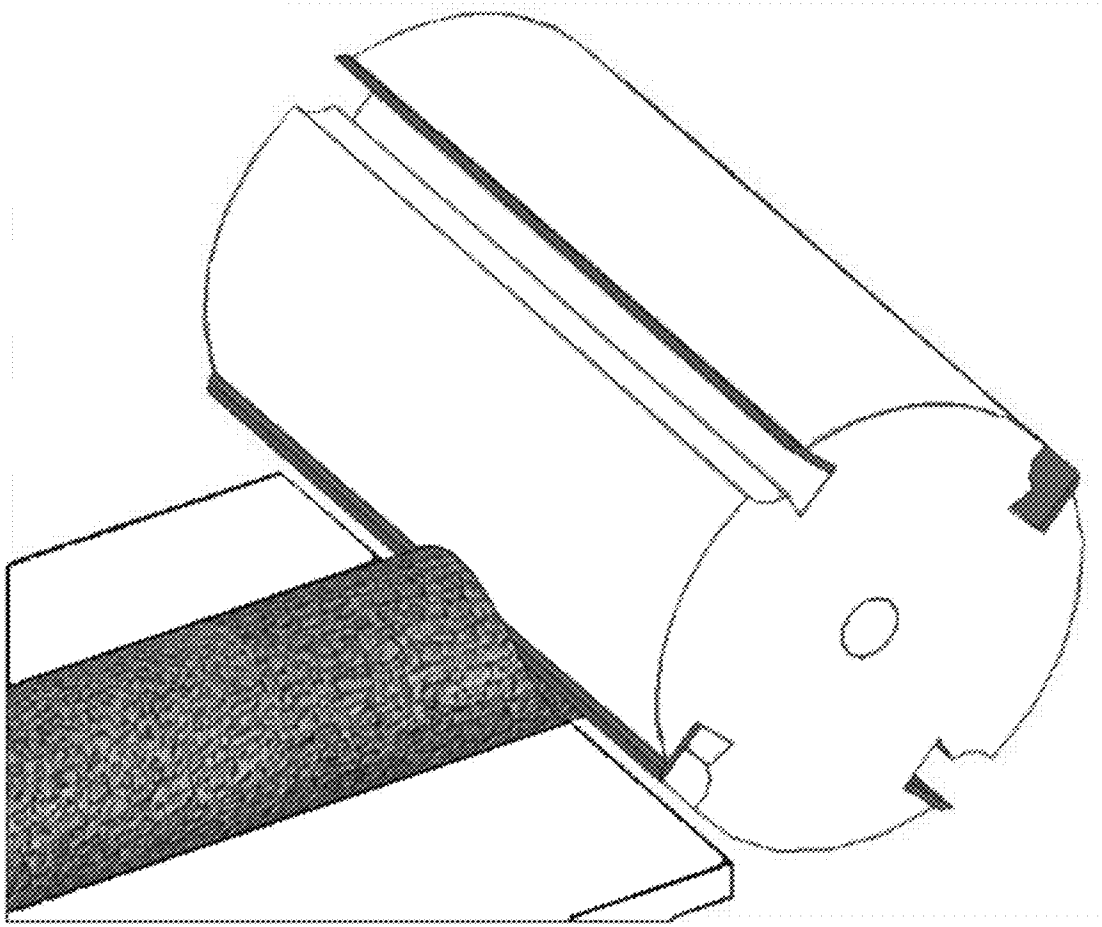
FIG. 15 is a sketch showing the basic operating features of a wood chipper with a drum shaped chipper blade.

Any suitable method can be used to create the elongated wood infill particles having the wood grain oriented in the longest dimension. Optionally, one method that can be used is to cut or "chip" slices or discs of wood from a tree or wood piece using a wood chipper, with the cutting being across the grain using a cutting disc, as shown in FIG. 14, or a cutting drum as shown in FIG. 15. The resulting wood pieces will have the grain orientation in the direction of the thickness of the disc. The linear speed of the wood being fed into the chipper is controlled relative to the speed of the cutting disc or drum, such that the length of the cut wood discs is maintained between about 0.5 mm and about 10.0 mm. Then the wood discs are broken up into wood particles, using any suitable process. Optionally, one method to break up the chips is to use a hammer mill, whereby the hammers cleave the chips along the lengths of the grains. The broken wood chips are then centrifugally forced through a metal screen having a plurality of holes of a certain diameter, and the resulting wood particles will have the wood grain predominantly oriented in the elongated direction of the particle. In one embodiment, at least about 40 percent of the elongated particles will have the wood grain oriented in the elongate direction of the particle. In another embodiment, at least about 60 percent of the elongated particles will have the wood grain oriented in the elongate direction of the particle. In yet another embodiment, at least about 70-80 percent of the elongated particles will have the wood grain oriented in the elongate direction of the particle. Using this method, controlling the thickness of the wood chips produced by the chipper is essential for making infill wood particles of the right size, size distribution, and grain orientation. Logs are fed into the chipper using hydraulically driven feed rollers that can be controlled to provide a steady feed rate, such that the chipper disc or drum operates at a near constant speed. The chip thickness can be thereby maintained to between one and six millimeters. The wood chips are processed through a hammer mill, which breaks up the chips by cleaving them along grain boundaries. The rotational speed of the hammers and the size of the opening in the screens control the cross-sectional area of the wood particles, which preferably range from one square millimeter to nine square millimeters. If the screen size or diameter is too large, the wood particles' residence time in the hammer mill is too short to break the chips down to the preferred particle size. If the screen size is too small, the chips may be broken down too much, so that the particle size distribution results in too many fine particles that cannot be used as infill.

While the chipper and hammer mill process conditions can be set to make the preferred particle sizes, a certain percentage of particles are expected to be larger or smaller than that range. A mechanical sieve is used to separate the larger and smaller particles from the preferred infill particles. Larger particles may be processed through the hammer mill a second time as a portion of the primary feed stream. Fine particles may be collected and sold as ingredients for fuel pellets for example.

Moisture content during processing also affects the size and size distribution of the wood particles. Logs that are fresh cut hold approximately 50% moisture. When fresh cut logs are chipped it is easier to maintain a clean cut of chips from the log and the chip thickness is easier to maintain. Fresh logs are less susceptible to fracturing than dry logs when they are chipped. Fractured logs create long shards and splinters that pass through the chipper. These shards and splinters are difficult to cut into the preferred particle sizes in the hammer mill, which yields either an excess of oversized particles that must be reprocessed, or a quantity of smaller splinters and shards that can give the infill a coarser feel than is desired. Dry logs also generate more fines or wood flour when chipped. Although the wood flour has usefulness in alternate products like fuel pellets, it is preferred that the percentage of infill wood particles be as high as possible.

After the fresh logs are chipped, the wood chips may optionally be processed through the hammer mill immediately. The wet chips cleave after being impacted by the hammers and pass through the screen. If the screen holes are relatively small diameter, some of the wet wood particles may build up on the screens and eventually cause a blockage in the screen openings, increasing the residence time of the particles in the mill. The wet particles may shred into thin fibrous strands that are mechanically less durable than the preferred particle sizes. To avoid screen blockage, either a screen with larger diameter holes may be used or the chips may be dried or partially dried before being milled. The chips may be dried to a moisture content of 25-40% moisture before being milled, or alternatively the chips may be dried to 10-25% moisture before being milled.

Wood particles that have been processed through the mill should be preferably dried to a moisture content of 15% or less prior to being sized through a mechanical sieve. Alternatively, the wood particles may be dried to a moisture content of approximately 25% before being sized. The finished infill wood particles may be stored in a storage facility protected from precipitation or they may be packaged in breathable bulk storage sacks for immediate shipment and delivery to the customer.

It is practically impossible to prevent long splinters or shards of wood from being created during the wood chipping process. Even with subsequent milling and screening operations, some of the splinters and shards remain in the mix and give the particles the appearance of being abrasive and conducive to skin punctures, lacerations, and slivers.

To eliminate the splinters and shards, the wood particles may be processed through an indent separator, which selectively separates long splinters and shards from the particles of desired length. Indent separators are commonly used to separate grass seeds from weed seeds in the lawn and turf industry. The particles to be separated are passed through the internal surface of a rotating steel cylinder shell having small hemispherical or other geometric shaped depressions in the surface. The wood particles having the desired size and shape are captured in the surface depressions or indents and are carried upward as the cylinder rotates. At a certain position the particles fall out of the depressions and are captured in a trough positioned in approximately the axial center of the cylinder. An auger in the trough conveys the particles to a material handling system for further processing. Particles having an unacceptably long length are not picked up in the cylinder indents and get conveyed down the length of the cylinder and removed from the process.

Wood particles processed using wood chippers and hammer mills may have edges that are angular or sharp because of the way the chipper blades or mill hammers cut or cleave the wood. During athletic play on a synthetic field infilled with those wood particles an athlete may slide across the turf surface, and the wood particle edges may have a rough feel against the skin. To reduce the apparent roughness of the infilled turf, the wood particles may optionally be processed to round off the edges of the particles. In one embodiment, the particles may be processed to exhibit an ellipsoid or even a spherical or near spherical shape.

Wood particles that have been chipped, milled, dried, and screened may optionally be pneumatically conveyed through cyclonic dust handling equipment that has been modified to include rough internal surfaces and narrow air passages so that the particles may strike the rough surfaces and abrade the angular and sharp edges of the particles. The fine wood dust that abrades from the wood particles may then be collected in the filter bags and saved for use as fuel in wood dust fired processing ovens or in alternative wood flour products like fuel pellets.

Alternatively the processed wood particles may be conveyed and tumbled through a drum containing deburring media consisting of e.g. stone, ceramic, or metal shapes that strike the wood particles as they tumble, either flattening out or abrading the angular or sharp edges.

Another process to remove the rough edges and surfaces of the wood particles consists of conveying the chipped, dried, and milled wood particles into a cylindrical internal mixer that has a center rotating shaft with paddles resembling turbine blades projecting radially from the shaft. The paddles have flat surfaces that agitate and displace the wood particles axially down the interior cavity of the mixer. As the particles collide with one another the surfaces abrade slightly, causing the edges of the particles to become slightly rounded and the surfaces smoother.

Under certain processing conditions, the oversized wood particles that are screened out from the infill can be utilized as a soil additive replacement for pearlite, providing a revenue stream that has higher value than other applications for infill process byproducts. Wet wood chips may be optionally dried to a moisture content of 25-40% moisture, then processed in a hammer mill using a hammer rotational speed of e.g. 2000 rpm. A small hammer mill screen size may be optionally used (e.g. 0.250 inch diameter). The oversized particles resulting from this process are generally cuboid in shape with the quadrilateral faces being square or slightly rectangular, and having edge dimensions of between five and seven millimeters.

Turf and infill wear that results from athletic play on the surface can be simulated with a Lisport Classic tester. A pair of heavy cleated rollers traverse an infilled turf sample in forward and reverse directions for a prescribed number of cycles. The rollers are coupled with sprockets and chain so that they rotate at different angular velocities, thereby introducing shear and penetration into the turf and infill and thus simulating athletic shoe movement. When the wood particle infill described in the invention is subjected to the Lisport test, the particles become slightly rounded due to wear, making them feel less abrasive than when they are first processed.

A chemical additive may be applied to the freshly processed wood particles to make them feel softer and less abrasive. In one embodiment a mixture of glycerin and water may be added to the wood particles using any of several kinds of batch or continuous mixers so that the fluid is adsorbed into the surfaces of the wood particles. The glycerin gives the particles a somewhat slippery surface that feels soft to the touch. As the infilled turf is subjected to athletic use, precipitation, and irrigation the glycerin on the surface washes away or is dissolved out of the particle surfaces. But in the meantime the particles are mechanically abraded by athletic activity and the infill maintains a soft, relatively unabrasive feel.

Colorants may be added to the wood particles to enhance the aesthetics of the infill when worked into the turf. Naturally occurring pigments like iron oxide may be used to enhance color without the use of potentially harmful ingredients. Colorants may be changed to suit the thermal requirements of different climatic regions. Light colored infill may be produced for southern installations to better reflect the heat. Darker infill may be produced for northern installations to promote more rapid moisture evaporation and snow melt.

In an alternative configuration of infill, wood particles configured as entanglement additive particles from the same trees as previously described, but with a cross sectional area of about 0.25 square millimeters and an aspect ratio of 10:1 to 50:1 may be blended with the previously described wood chips to form a network of entangled particles that help prevent the wood particles from being washed away in a heavy rain. The entangled particles also provide stability and traction for athletes whose cleats initially grab the entangled particles, but then break free with a nominal amount of torsional energy.

This invention also considers the entire turf system in solving the problems of compaction of organic infills and the poor water drainage seen with organic infilled fields. Some organic infills are not very resilient, particularly if the playing surfaces on which they are installed are not well maintained. The playing field may become hard over time, which increases the risk of players sustaining injuries. A configuration of this invention therefore incorporates an expanded polypropylene shock pad beneath the synthetic turf to provide firm footing for athlete performance while running, but superior impact attenuation to help reduce the potential for head and body injuries.

In another turf system the various combinations of above described organic infills are placed over a layer of coarse sand which has average grain diameters ranging between 0.5 mm and 2.5 mm, or approximately the same as the cross sectional area of the wood particles in the organic infill. The size of the sand grains helps facilitate vertical water drainage as compared with typical sand layers in which the grains are less than 1.0 mm in diameter.

In another turf system the above described organic infills, coarse sand, and EPP underlayment are combined with a synthetic turf having a means of draining water through the turf and turf backing.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An infill material for an artificial turf assembly comprising:

a plurality of wood particles, at least a portion of the plurality of wood particles defining a length dimension greater than a width or a thickness dimension, the length dimension being oriented generally parallel to a grain structure of the wood particles, the length dimension in a range of about 0.5 mm to about 10 mm, the length and one of the width or thickness dimensions defining an aspect ratio within a range of 1:2 to 10:1, the portion of the plurality of wood particles having a generally rounded edge profile along at least the length dimension, and wherein the at least a portion of the plurality of wood particles maintains a water absorptive property that permits water to be retained by the portion of wood particles and released over time to disperse heat from the infill material.

2. The infill material of claim 1 wherein the plurality of wood particles are formed from at least one of a heartwood or sapwood component of a hardwood or a softwood species and having width to thickness dimensions in a range of about (0.5 mm to 5 mm)×(0.5 mm to 5 mm) defining a cross section and the length dimension in a range from about 1 mm to about 5 mm.

3. The infill material of claim 2 wherein the wood particles have a hardness measured on a Janka scale within a range of from about 500 to about 2500.

4. The infill material of claim 1 further including sand wherein the plurality of wood particles and the sand forms a weight ratio of sand to wood particles in at least one of a range of about 1:1 to about 10:1.

5. The infill material of claim 1 further including sand wherein the plurality of wood particles and the sand are combined as a mixture, the mixture configured to be deposited onto an artificial turf carpet.

6. The infill material of claim 4 wherein the wood particle length is between greater than 3 mm and less than 7 mm and the aspect ratio is between 3:1 to 7:1.

7. The infill material of claim 4 wherein the wood particle length is between greater than 1 mm and less than 5 mm and the aspect ratio is between 1:1 and 5:1.

8. The infill material of claim 1 further including sand and wherein the plurality of wood particles are combined with wood entanglement particles having at least one of a cross sectional area of about 0.25 square millimeter or a length to width ratio within the range of from about 10:1 to about 50:1 and wherein the sand has an average grain diameter in a range of about 0.5 mm to about 2.5 mm.

9. The infill material of claim 1 wherein the plurality of wood particles are coated in glycerin to provide an unabrasive tactile perception to the plurality of wood particles exhibiting angular edges.

10. The infill material of claim 1 wherein the plurality of wood particles are combined with a resilient material.

11. The infill material of claim 10 wherein the resilient material is one of styrene-butadiene rubber, thermoplastic elastomer, ethylene propylene diene monomer, or cork.

12. The infill material of claim 1 wherein the generally rounded edge profile is a mechanically abraded, deburred edge.

13. The infill material of claim 12 wherein the portion of wood particles having the mechanically abraded, deburred edge are substantially ellipsoid shaped or substantially spherical shaped wood particles having generally smooth outer surfaces.

14. The infill material of claim 12 wherein the plurality of wood particles are applied to a turf carpet of an artificial ornamental lawn.

15. An artificial turf assembly comprising:

a turf carpet having a plurality of spaced apart synthetic grass blades; and an infill material dispersed onto the turf carpet between the grass blades, the infill material including sand and a plurality of wood particles, at least a portion of the plurality of wood particles defining a length dimension greater than a width or a thickness dimension, the length dimension being oriented generally parallel to a grain structure of the portion of wood particles, the length dimension being in a range of about 1 mm to about 10 mm, the length and one of the width or thickness dimensions defining an aspect ratio within a range of 1:2 to 10:1, and wherein the plurality of wood particles maintains a water absorptive property that permits water to be retained by the infill material and released over time to disperse heat.

16. The artificial turf assembly of claim 15 wherein the turf carpet includes a backing layer to which the spaced apart synthetic grass blades are attached, the infill material being dispersed onto the turf carpet in layers wherein a first layer is formed from the sand in a depth range of about 5 mm to about 25 mm and a second layer is dispersed over the first layer and comprising the plurality of wood particles in a depth range of about 5 mm to about 25 mm.

17. The artificial turf assembly of claim 15 wherein the portion of wood particles have substantially deburred edges along at least the length dimension providing a generally rounded edge profile.

18. The artificial turf assembly of claim 15 including an underlayment layer.

19. The artificial turf assembly of claim 18 wherein the infill material defines a first spring rate of the artificial turf assembly and the underlayment layer defines a second spring rate that is lower in magnitude than the first spring rate such that loads applied to the artificial turf assembly are substantially transferred to the underlayment layer and the second spring rate provides a majority of a reactionary response load back through the artificial turf assembly against the applied load.

20. The artificial turf assembly of claim 18 wherein the underlayment layer is composed of one or more of extruded crosslinked polyethylene foam, extruded non-crosslinked polyethylene foam, ground and thermally bonded pieces of crosslinked polyethylene foam, heat bonded non-crosslinked polyethylene foam, or ground rubber particles.

21. The artificial turf assembly of claim 18 wherein the underlayment layer is a molded plastic grid including a lattice network formed by beam elements and supported by column elements, at least one of the beam elements or column elements are flexible to provide a resiliency characteristic to the underlayment layer.

22. The artificial turf assembly of claim 19 wherein the underlayment layer is one of an expanded polyethylene or polypropylene foam board material having a core and a plurality of projections extending from the core and in contact with a backing layer of the turf carpet, the plurality of projections defining the second spring rate and the core defining a third spring rate that is greater than the second spring rate and equal to or less than the first spring rate.

23. The artificial turf assembly of claim 19 wherein the wood particle length is between greater than 3 mm and less than 7 mm and the aspect ratio is between 3:1 to 7:1, and wherein a weight ratio of sand to wood particle is between 2:1 and 4:1.

24. The artificial turf assembly of claim 19 wherein the wood particle length is between greater than 0.5 mm and less than 5 mm and the aspect ratio is between 1:1 to 5:1, and wherein a weight ratio of sand to wood particle is between 4:1 and 8:1.

25. An artificial turf system comprising:

a turf carpet having a plurality of spaced apart synthetic grass blades attached to a backing layer;

an underlayment layer at least partially formed from expanded polyethylene or polypropylene bead material having a density in a range of 20-90 g/l; and an infill material dispersed onto the turf carpet between the grass blades, the infill material including sand and a plurality of wood particles, at least a portion of the plurality of wood particles defining a length dimension greater than a width or a thickness dimension, the length dimension being oriented generally parallel to a grain structure of the wood particles, the length dimension in a range of about 1 mm to about 10 mm, the length and one of the width or thickness dimensions defining an aspect ratio within a range of 1:2 to 10:1, and wherein the portion of wood particles maintains a water absorptive property that permits water to be retained by the portion of wood particles and released over time to disperse heat from the infill material.

26. The artificial turf system of claim 25 wherein the portion of the plurality of wood particles have substantially deburred edges along at least the length dimension providing a generally rounded edge profile.

27. The artificial turf system of claim 25 wherein the turf carpet and infill material disposed onto the turf carpet define a first spring rate and the underlayment layer defines a second spring rate that is more compliant than the first spring rate.

28. The artificial turf system of claim 27 wherein the second spring rate of the underlayment layer is associated with a deflection control layer and the underlayment layer further defines a third spring rate associated with a core section, such that the first spring rate is stiffer than the third spring rate and the third spring rate is stiffer than the second spring rate.

29. The artificial turf system of claim 25 wherein the underlayment layer includes a plurality of projections disposed across an upper support surface of the underlayment in contact with the turf carpet.

* * * * *